US012690694B2

(12) United States Patent
Guo et al.

(10) Patent No.: US 12,690,694 B2
(45) Date of Patent: Jul. 28, 2026

(54) ENGAGING DEVICE FOR FIXING A BABY CARRIER TO A HIGH CHAIR OF AN INFANT SEAT ASSEMBLY

(71) Applicant: Wonderland Switzerland AG, Steinhausen (CH)

(72) Inventors: Zhengwen Guo, Dongguan (CN); Huan Ning, Dongguan (CN); Zhiyang He, Dongguan (CN)

(73) Assignee: Wonderland Switzerland AG, Steinhausen (CH)

( * ) Notice: Subject to any disclaimer, the term of this patent is extended or adjusted under 35 U.S.C. 154(b) by 138 days.

(21) Appl. No.: 18/585,557

(22) Filed: Feb. 23, 2024

(65) Prior Publication Data

US 2024/0285094 A1 Aug. 29, 2024

(30) Foreign Application Priority Data

Feb. 24, 2023 (CN) ..... 202310175376.5

(51) Int. Cl.
*A47D 1/04* (2006.01)
*A47D 1/00* (2006.01)
*A47D 13/02* (2006.01)

(52) U.S. Cl.
CPC ..... *A47D 1/04* (2013.01); *A47D 1/006* (2013.01); *A47D 13/025* (2013.01)

(58) Field of Classification Search
CPC ..... A47D 1/006; A47D 1/008
See application file for complete search history.

(56) References Cited

U.S. PATENT DOCUMENTS

| | | | | |
|---|---|---|---|---|
| 1,292,200 | A | 1/1919 | Williams | |
| 2,728,374 | A | 12/1955 | Whalen | |
| 5,143,420 | A | 9/1992 | Switlik | |
| 7,032,970 | B1 | 4/2006 | Kharat | |
| 10,932,588 | B2 * | 3/2021 | Dziak | A47D 1/023 |
| 2003/0209926 | A1 | 11/2003 | Nakagawa et al. | |

(Continued)

FOREIGN PATENT DOCUMENTS

| | | | |
|---|---|---|---|
| CN | 102835854 | A | 12/2012 |
| CN | 104706090 | B | 1/2018 |

(Continued)

OTHER PUBLICATIONS

Extended European Search Report issued in corresponding EP Application No. 24159609.7 dated Jun. 18, 2024.

(Continued)

*Primary Examiner* — Arfan Y. Sinaki
(74) *Attorney, Agent, or Firm* — Volpe Koenig

(57) ABSTRACT

An engaging device and an infant seat assembly having the engaging device. The engaging device is adapted to fix the baby carrier to the high chair, the baby carrier has a crossbar and the high chair has a carrier base. The engaging device includes an engaging base and a first engaging mechanism. The engaging base is adapted to be connected to the carrier base. The first engaging mechanism is movably disposed on the engaging base. The first engaging mechanism is adapted to releasably engage the crossbar with the engaging base. The infant seat assembly includes a high chair and the engaging device. The baby basket is detachably mounted to the carrier base of the high chair by the engaging device.

30 Claims, 23 Drawing Sheets

(56) References Cited

U.S. PATENT DOCUMENTS

| | | | | |
|---|---|---|---|---|
| 2014/0368006 | A1 | 12/2014 | Taylor et al. | |
| 2015/0157140 | A1 | 6/2015 | Yang | |
| 2017/0079446 | A1 | 3/2017 | Bellows et al. | |
| 2023/0000263 | A1 * | 1/2023 | Sclare | A47D 1/0085 |

FOREIGN PATENT DOCUMENTS

| | | | |
|---|---|---|---|
| CN | 208388274 | U | 1/2019 |
| CN | 212500026 | U | 2/2021 |

OTHER PUBLICATIONS

"First Office Action Issued in Corresponding Japanese Patent Application No. 2024-026845", along with Partial Translation, Mailed Date: Nov. 5, 2024, 5 pages.
EPO Communication pursuant to Article 94(3) EPC for corresponding European Application No. 24159609.7 dated Feb. 26, 2026, 7 pages.

* cited by examiner

ENGAGING DEVICE FOR FIXING A BABY CARRIER TO A HIGH CHAIR OF AN INFANT SEAT ASSEMBLY

CROSS-REFERENCE TO RELATED APPLICATIONS

This application claims priority to Chinese Patent Application No. 2023101753765, filed on Feb. 24, 2023, named "ENGAGING DEVICE AND INFANT SEAT ASSEMBLY", the content of which is hereby incorporated by reference in its entirety.

TECHNICAL FIELD

The present disclosure relates to the technical field of infant carrier, and more particularly, to an engaging device and an infant seat assembly having the engaging device.

BACKGROUND

Children high chairs are generally used by infants when eating with adults at the table. The high chair on the market realizes switching between different use modes by mounting different seats thereon, thereby meeting the use requirements of infants of different ages and prolonging the use time of the high chair. However, at present, the high chair on the market cannot be engaged to the baby carrier, and it is difficult to fix the baby carrier to the high chair conveniently and quickly.

SUMMARY

Accordingly, the present disclosure provides an engaging device which is capable of being detachably connected to a baby carrier and a high chair, respectively, so that the baby carrier can be conveniently and quickly fixed to the high chair.

According to one aspect of the present disclosure, an engaging device adapted to fix a baby carrier to a high chair is provided, the baby carrier has a crossbar and the high chair has a carrier base.

The engaging device includes an engaging base and a first engaging mechanism. The engaging base is adapted to be connected to the carrier base. The first engaging mechanism is movably disposed on the engaging base. The first engaging mechanism is adapted to releasably engage with the crossbar to the engaging base.

In one of the embodiments, the first engaging mechanism includes an unlocking member movably connected to the engaging base and switchable between a locked state and an unlocked state. The unlocking member has an engaging portion. When the unlocking member is in a locked state, the engaging portion is engaged with the crossbar, and when the unlocking member is in the unlocked state, the crossbar is disengaged from the engaging portion.

In one of the embodiments, an accommodating cavity is formed inside the engaging base. At least a part of the unlocking member is located within the accommodating cavity. A part of the unlocking member located within the accommodating cavity has a connecting portion. The connecting portion is pivotally connected to a cavity wall of the accommodating cavity. The engaging portion is capable of extending beyond the accommodating cavity to be engaged with the crossbar.

In one of the embodiments, the engaging portion has a first engaging surface and the engaging base has a second engaging surface. When the unlocking member is in a locked state, the first engaging surface and the second engaging surface are arranged opposite to each other, and the crossbar is engaged between the first engaging surface and the second engaging surface.

In one of the embodiments, the unlocking member is movably connected to the engaging base, the engaging portion has a wedge surface adapted to be pushed against by the crossbar to enable the unlocking member to move.

In one of the embodiments, the engaging portion has a first engaging surface, when the unlocking member is in the unlocked state, the crossbar is engaged between the first engaging surface and the engaging base, and the wedge surface and the first engaging surface are connected to each other and are angularly arranged.

In one of the embodiments, the unlocking member has a first position and a second position, when the unlocking member is in the first position and in the locked state, the unlocking member is adapted to move from the locked state, via the second position, to the unlocked state; when the unlocking member is in the first position and in the unlocked state, the unlocking member is adapted to move from the unlocked state, via the second position, to the locked state.

In one of the embodiments, the engaging portion has a wedge surface, the wedge surface is adapted to be pushed against by the crossbar to enable the unlocking member to move from the first position to the second position.

In one of the embodiments, the first engaging mechanism further includes a first resilient member, the first resilient member is arranged between the unlocking member and the engaging base, the first resilient member is adapted to bias the unlocking member to cause the unlocking member to move to the first position.

In one of the embodiments, the first engaging mechanism further includes an indication member. The indication member is movably disposed at the engaging base and switchable between at least two indication states to indicate an engaged state or a disengaged state of the unlocking member with the crossbar.

In one of the embodiments, the indication member is provided with indication marks indicating at least two indication states, respectively, an accommodating cavity is formed inside the engaging base, the indication member is disposed in the accommodating cavity, and the engaging base is provided with an indication window for displaying any of the indication marks.

In one of the embodiments, the at least two indication states include a first indication state for indicating that the crossbar is disengaged from the first engaging mechanism and a second indication state for indicating that the crossbar is engaged with the first engaging mechanism.

In one of the embodiments, the first engaging mechanism further includes a second resilient member adapted to bias the indication member toward the first indication state.

In one of the embodiments, the first engaging mechanism includes an abutting member movably disposed on the engaging base and switchable between at least two indication states.

In one of the embodiments, the abutting member is switchable between an extended position and a retracted position. When the abutting member is switched from the extended position to the retracted position, the abutting member pushing the indication member to switch from a first indication state for indicating that the crossbar is disengaged from the first engaging mechanism to a second indication state for indicating that the crossbar is engaged with the first engaging mechanism.

In one of the embodiments, the indication member has a first driving bevel and an end of the abutting member is provided with a second driving bevel adapted to abut against the first driving bevel to drive the indication member to switch between the at least two indication states.

In one of the embodiments, the abutting member is switchable between an extended position and a retracted position. When the abutting member is in the retracted position, the crossbar is capable of being engaged between the first engaging surface and the abutting member. When the abutting member is in the extended position, the crossbar is disengaged from the first engaging surface.

In one of the embodiments, another end of the abutting member is an abutting end abutting against the crossbar to enable the crossbar to drive the abutting member to switch from the extended position to the retracted position.

In one of the embodiments, the engaging device further includes a second engaging mechanism. The second engaging mechanism includes an engaging member, a resilient arm and a first engaging projection. The engaging member is connected to the carrier base and provided with a first engaging hole. The resilient arm is connected to the engaging base. The first engaging projection is disposed on the resilient arm and is adapted to be engaged with the first engaging hole.

In one of the embodiments, the engaging member and the carrier base form a mounting groove for mounting at least a part of the engaging base. When at least a part of the engaging base is inserted into the mounting groove, the resilient arm enters the mounting groove and the first engaging projection is engaged with the first engaging hole.

In one of the embodiments, the engaging base has an opening groove. An end of the resilient arm is connected to a groove wall of the opening groove. The first engaging projection has an engaged position, in which the first engaging projection protrudes from the opening groove; and a retracted position, in which the first engaging projection 1421 does not protrude from the opening groove 118. When the first engaging projection is in the engaged position, the first engaging projection is adapted to be engaged with the first engaging hole. When the engaging base is inserted into the mounting groove, the engaging member is capable of pushing the first engaging projection to move to the retracted position. The resilient arm is adapted to bias the first engaging projection to move the first engaging projection to the engaged position.

In one of the embodiments, the engaging base is provided with a clamping slot. When the first engaging projection is engaged with the first engaging hole, at least a part of the carrier base is inserted into the clamping slot.

In one of the embodiments, the engaging base is provided with a clamping slot having a first side wall. The opening groove is provided on the first side wall. The engaging member and the carrier base form a mounting groove for insertion of the engaging base. When at least a part of the engaging base is inserted into the mounting groove, at least a part of the carrier base is inserted into the clamping slot, and the first engaging projection is engaged with the first engaging hole.

According to another aspect of the present disclosure an infant seat assembly including a high chair and the aforementioned engaging device is provided. A baby carrier is adapted to be detachably mounted to the carrier base of the high chair by the engaging device.

In one of the embodiments, the infant seat assembly further includes a third engaging mechanism. The high chair further includes a backrest. The baby carrier is adapted to be detachably connected to the backrest by the third engaging mechanism.

In one of the embodiments, the first engaging mechanism includes an engaging groove and a locking hook member. The engaging groove is disposed on the backrest. A side wall of the engaging groove is provided with a first protruding portion that is spaced apart from a bottom wall of the engaging groove to form a locking hook groove. The locking hook member is disposed on the baby carrier. The locking hook member has a hook body adapted to be engaged in the locking hook groove to fix the locking hook member in the engaging groove.

In one of the embodiments, the third engaging mechanism further includes a decorative cover movably disposed on the engaging groove. The decorative cover is adapted to cover a notch of the engaging groove when the hook body is not engaged with the locking hook groove.

In one of the embodiments, the decorative cover has a first end away from the bottom wall of the engaging groove and a second end facing toward the bottom wall of the engaging groove. The second end is provided with a second protruding portion. The second protruding portion is located between the first protruding portion and the bottom wall of the engaging groove. The decorative cover is switchable between a third position and a fourth position. When the decorative cover is located in the third position, the first end is flush with a surface of the backrest and the second protruding portion abuts against the first protruding portion. When the decorative cover is in the fourth position, the second protruding portion and the first protruding portion are spaced apart so that the hook body is capable of being engaged in the locking hook groove.

In one of the embodiments, the third engaging mechanism further includes a third resilient member disposed between the decorative cover and the bottom wall of the engaging groove. The third resilient member is adapted to bias the decorative cover to move to the third position.

In one of the embodiments, the high chair has a first component and a second component that are relatively movable, and an adjusting mechanism connected to the first component and the second component, respectively. The adjusting mechanism is switchable between a locked state and an unlocked state. When the adjusting mechanism is in the unlocked state, the first component is movable in a predetermined direction relative to the second component. When the adjusting mechanism is in a locked state, the first component is fixed relative to the second component.

In one of the embodiments, the adjusting mechanism includes a plurality of locking holes and a locking member. The plurality of locking holes is disposed in one of the first component and the second component and arranged in the predetermined direction. The locking member is movably connected to another of the first component and the second component. The locking member includes a locking portion and is switchable between a locked position and an unlocked position. The locking portion is inserted into any of the locking holes when the locking member is in the locked position, and the locking portion is disengaged from any of the plurality of locking holes when the locking member is in the unlocked lock position.

In one of the embodiments, the locking member further includes a locking body pivotally connected to the other of the first component and the second component by a pivot shaft. The locking portion is disposed at an end of the locking body, and the locking body is operable to switch the locking portion between the locked position and the unlocked position.

In one of the embodiments, the adjusting mechanism further includes a driving member. The driving member includes a driving portion and an operating portion. The driving portion abuts against the locking body, and the operating portion is operable to cause the driving portion to push the locking body to pivot.

In one of the embodiments, the adjusting mechanism further includes a driving member. The driving member includes a driving portion and an operating portion. The driving portion has a first abutting bevel. The locking body is provided with a second abutting bevel opposite to the first abutting bevel, and the operating portion being operable to cause the second abutting bevel to push against the first abutting bevel, causing the locking member to pivot.

In one of the embodiments, the adjusting mechanism further includes a fourth resetting member adapted to bias the locking member to pivot toward the locked position.

In one of the embodiments, the infant seat assembly further includes a connecting base fixed to the other of the first component and the second component. The connecting base is provided with an accommodating groove. The locking member is movably disposed in the accommodating groove. The locking portion is adapted to extend out of a notch of the accommodating groove to be inserted into any of the locking holes.

In one of the embodiments, the adjusting mechanism further includes a driving member. The driving member includes a driving portion and an operating portion. The driving portion abuts against the locking member. The bottom wall of the accommodating groove is provided with a strip hole. The operating portion extends out of the connecting base through the strip hole to be operated. The operating portion is operable to cause the driving portion to drive the locking member to switch between a locked position and an unlocked position.

In one of the embodiments, the adjusting mechanism further includes an operating member fixed to an end of the operating portion away from the driving portion, and the operating member is adapted to be operated.

In one of the embodiments, the one of the first component and the second component is provided with a strip slot. The plurality of locking holes is provided on a bottom wall of the strip slot, and at least a part of the connecting base is accommodated in and movable along the strip slot.

In one of the embodiments, the high chair includes a backrest and two side plates connected to two ends of the backrest, respectively. The carrier base is located between the two side plates and movable relative to the two side plates. The first component includes the carrier base, and the second component includes the side plate.

In one of the embodiments, the high chair includes a seat body, a plurality of support brackets for supporting the seat body, and a pedal located between two of the support brackets. The pedal is movable relative to the two support brackets. The first component includes the support bracket, and the second component includes the pedal.

In one of the embodiments, the infant seat assembly further includes a dinner plate and a blocking member. An end of the blocking member is connected to the dinner plate and another end of the blocking member is detachably connected to the carrier base.

In one of the embodiments, the other end of the blocking member is provided with a resilient finger. The resilient finger has a second engaging projection. The carrier base has a second engaging hole disposed therethrough. The second engaging projection is adapted to pass through the carrier base via the second engaging hole and abut against an end surface of the carrier base opposite to the dinner plate.

REFERENCE SIGNS

Figure 1:
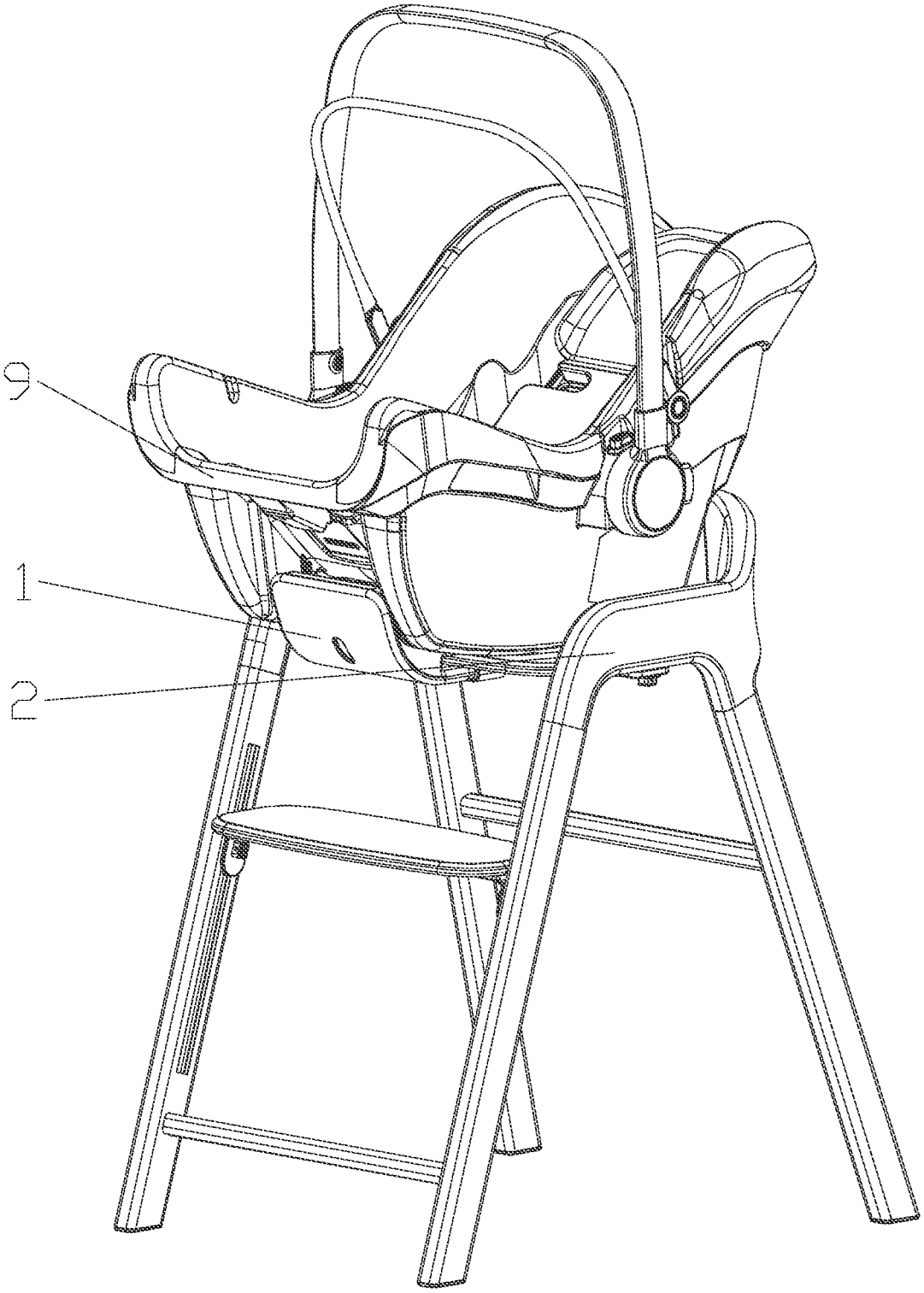
FIG. 1 is a schematic structural diagram of an infant seat assembly in a first use mode in which a baby carrier is fixed to a high chair according to an embodiment of the present disclosure.

1: engaging device; 11: engaging base; 111: clamping slot; 1111: second side wall: 1112: first side wall; 112: accommodating cavity; 113: second engaging surface; 114: first projection; 116: receiving slot; 117: indication window; 118: opening groove; 12: first engaging mechanism; 121: unlocking member; 1211: engaging portion; 1212: connecting portion; 1213: first engaging surface; 1214: wedge surface; 122: first resilient member; 123: indication member; 1231: first driving bevel; 1232: indication mark; 124: abutting member; 1241: abutting end; 1242: second driving bevel; 125: second resilient member; 13: engaging slot; 14: second engaging mechanism; 141: engaging member; 1411: first engaging hole; 142: resilient arm; 1421: first engaging projection; 15: mounting groove;

2: high chair; 21: seat body; 211: carrier base; 2111: first side surface; 2112: second side surface; 2113: second engaging hole; 212: backrest; 2121: first back plate; 2122: second back plate; 213: side plate; 2131: first strip groove; 2132: first strip block; 22: support bracket; 221: front support bracket; 222: rear support bracket; 223: front cross bar; 224: rear cross bar; 225: second strip groove; 226: second strip block; 23*a*: first adjusting mechanism; 231: connecting base; 2311: accommodating groove; 23111: side wall of the accommodating groove; 23112: bottom wall of the accommodating groove; 2312: strip hole; 2313: guide groove; 2314: recess; 232: locking member; 2321: locking portion; 2322: locking body; 2322*c*: third segment; 23221: first limiting surface; 23222: second limiting surface; 2323: second abutting bevel; 2324: projecting portion; 233: driving member; 2331: operating portion; 2332: driving portion; 23321: first abutting bevel; 234: fourth resetting member; 235: operating member; 2351: non-slip pattern; 236: locking hole; 237: pivot shaft; 23*b*: second adjusting mechanism; 24: pedal;

3: third engaging mechanism; 31: locking hook member; 311: hook body; 32: engaging groove; 32*a*: first hole portion; 32*b*: second hole portion; 321: first protruding portion; 322: bottom wall of the engaging groove; 323: third protruding portion; 324: receiving hole; 325: locking hook groove; 33: decorative cover; 331: first end; 332: second end; 333: second protruding portion; 334: fourth protruding portion; 34: third resilient member;

4: dinner plate;

5: blocking member; 51: resilient finger; 511: second engaging projection; 512: operating projection; 52: limiting projection;

9: baby carrier; and 91: crossbar.

DETAILED DESCRIPTION OF THE EMBODIMENTS

The above objects, features, and advantages of the present invention will become more apparent by describing in detail embodiments thereof with reference to the accompanying drawings. In the following description, numerous specific details are set forth in order to provide a thorough understanding of the present disclosure. However, the present disclosure can be implemented in many other ways than those described herein, and such modifications may be made by those skilled in the art without departing from the scope of the disclosure, which is therefore not to be limited to the specific embodiments disclosed below.

In the description of the present disclosure, it should be understood that the terms "center", "longitudinal", "lateral", "length", "width", "thickness", "upper", "lower", "front", "back", "left", "right", "vertical", "horizontal", "top", "bottom", "inner", "outer", "clockwise", "counterclockwise", "axial", "radial", "circumferential" and other indicated orientations or positional relationships are based on the orientations or positional relationships shown in the accompanying drawings, and are only for the convenience of describing the present disclosure and simplifying the description, rather than for indicating or implying that the indicated device or elements must have a particular orientation, or constructing and operating in a particular orientation, and are therefore not to be construed as limitations of the present disclosure.

In addition, the terms "first" and "second" are only used for descriptive purposes, and should not be construed as indicating or implying relative importance or implying the number of indicated technical features. Thus, features delimited with "first" or "second" may expressly or implicitly include at least one of these features. In the description of the present disclosure, "plurality" means at least two, such as two, three, etc., unless otherwise expressly and specifically defined.

In the present disclosure, unless otherwise expressly specified and limited, the terms "mounted", "connected to each other", "connected", "fixed" and other terms should be understood in a broad sense, for example, it may be a fixed connection or a detachable connection, or integrated; it can be a mechanical connection or an electrical connection; it can be directly connected or indirectly connected through an intermediate medium, it can be an internal connection of two elements or the interaction relationship between the two elements, unless otherwise specified limit. For those of ordinary skill in the art, the specific meanings of the above terms in the present disclosure can be understood according to specific situations.

In the present disclosure, unless otherwise expressly specified and limited, a first feature "on" or "under" a second feature may be the first feature is in direct contact with the second feature, or the first feature is in indirect contact with the second feature. Also, the first feature is "above", "over" and "on" the second feature may mean that the first feature is directly above or obliquely above the second feature, or simply means that the first feature has a higher level than the second feature. The first feature being "below", "beneath" and "under" the second feature may mean that the first feature is directly or obliquely below the second feature, or simply means that the first feature has a lower level than the second feature.

It should be noted that when an element is referred to as being "fixed to" or "disposed on" another element, it can be directly on the other element or an intervening element may also be present. When an element is considered to be "connected to" another element, it can be directly connected to another element or indirectly connected to another element with a mediating element. The terms "vertical", "horizontal", "up", "down". "left", "right" and similar expressions used herein are for illustrative purposes only and are not intended to be the only means of implementation.

Figure 2:
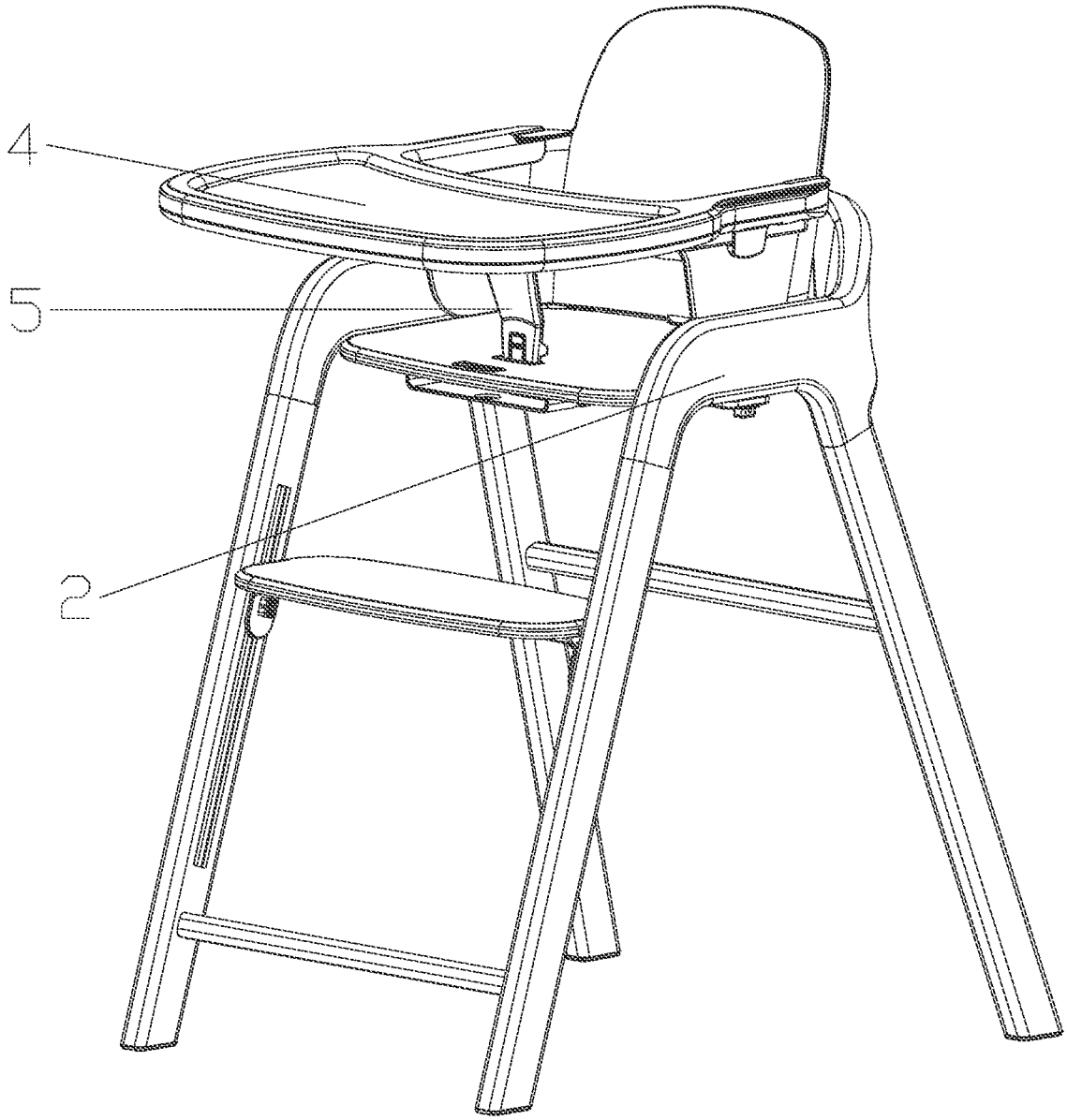
FIG. 2 is a schematic structural diagram of the infant seat assembly in a second use mode according to an embodiment of the present disclosure.
Figure 3:
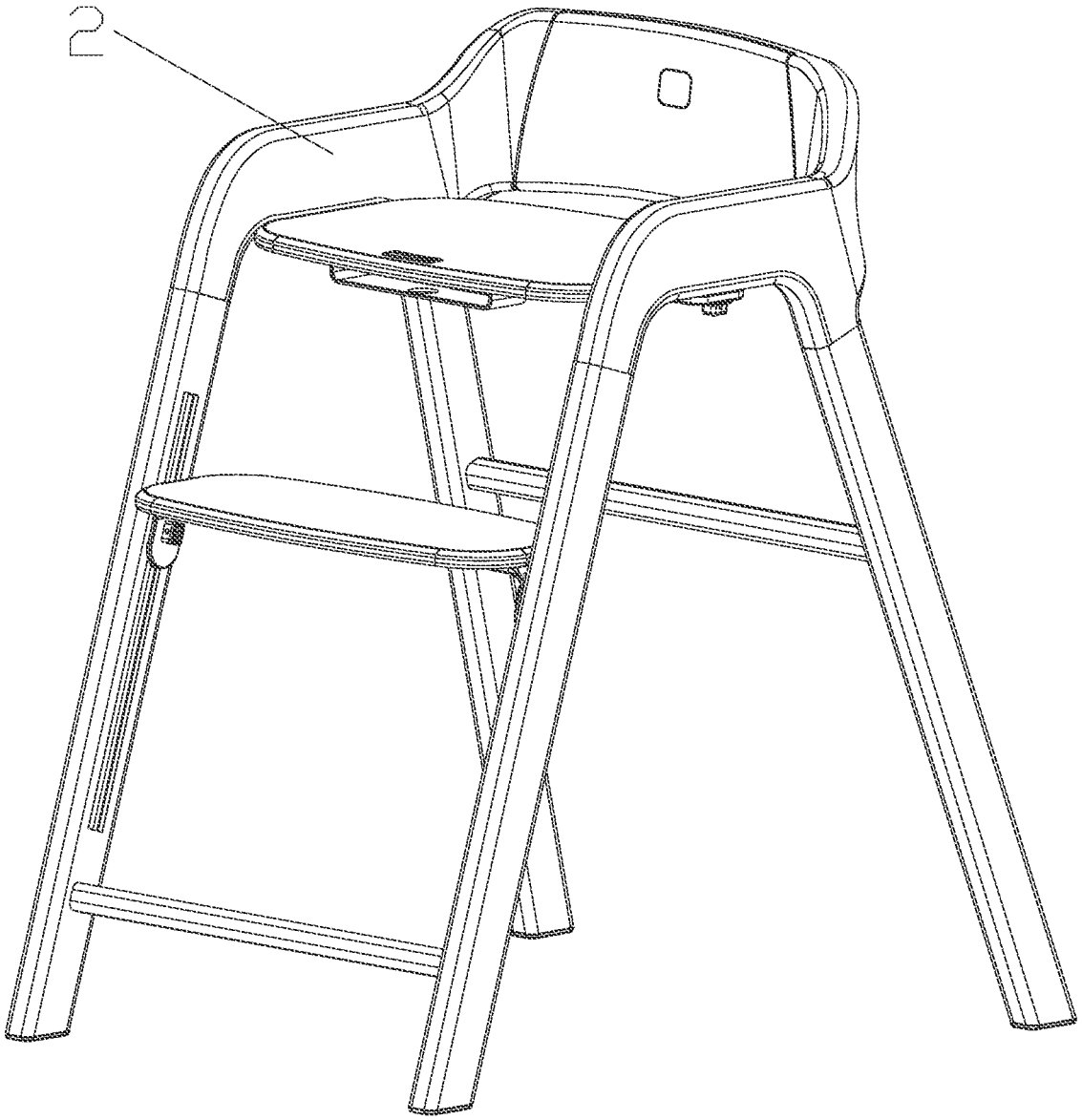
FIG. 3 is a schematic structural diagram of the infant seat assembly in a third use mode according to an embodiment of the present disclosure.

An embodiment according to the present disclosure provides an engaging device 1 and an infant seat assembly having the engaging device 1. As shown in FIGS. 1 to 3, the infant seat assembly includes a high chair 2 and an engaging device 1. The infant seat assembly has a variety of modes of use to accommodate the use needs of infants of different ages. The engaging device 1 is adapted to fix the baby carrier 9 to the high chair 2. The infant seat assembly includes a first use mode (see FIG. 1) in which the baby carrier 9 can be mounted on the high chair 2, a second use mode (see FIG. 2) for use as a dining chair, and a third use mode (see FIG. 3) for use as a seat. In the third use mode, the high chair 2 is used as a seat alone. Referring to FIG. 1, when the infant seat assembly is in the first use mode, the baby carrier 9 is detachably mounted to the high chair 2 by the engaging device 1.

Figure 4:
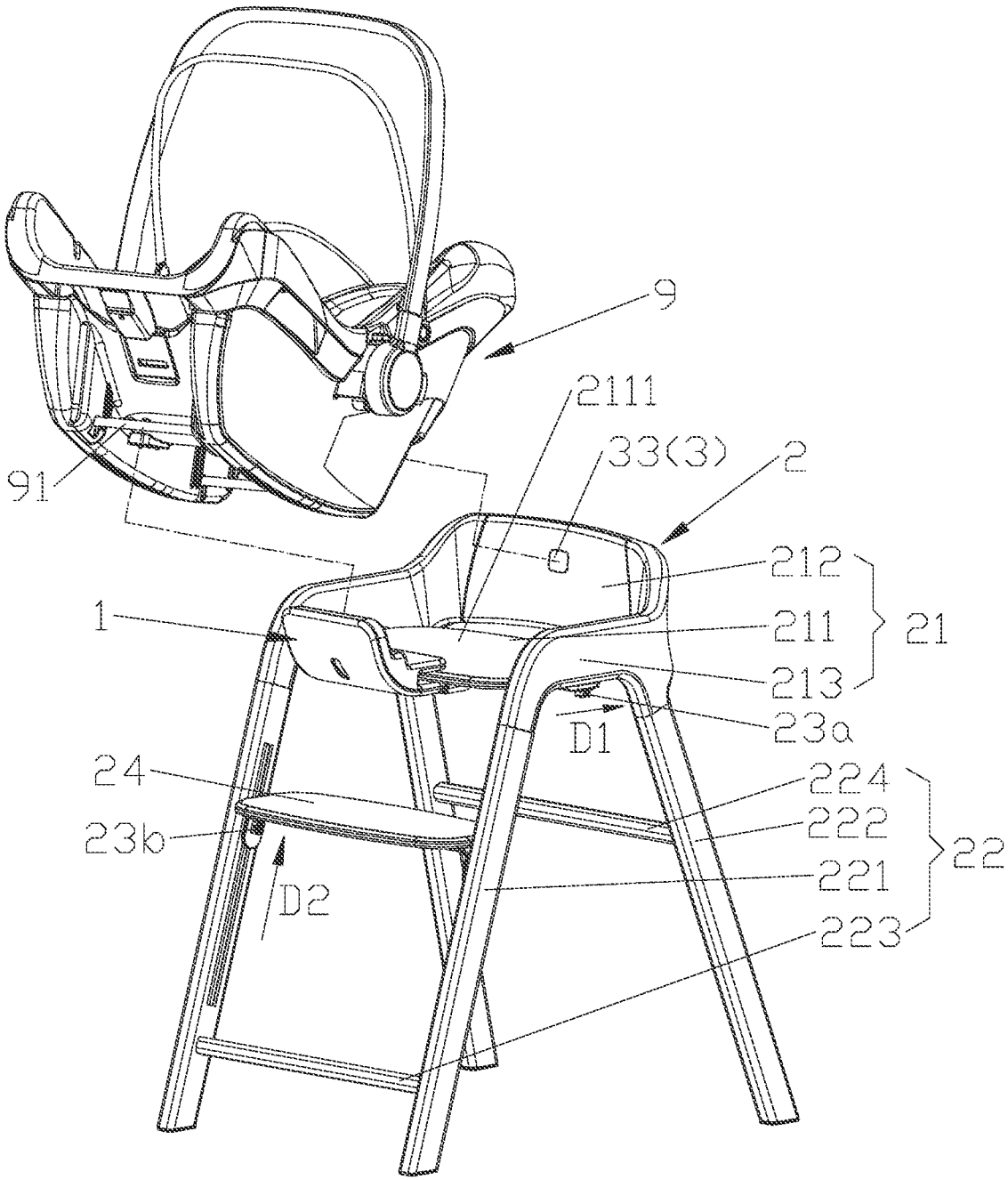
FIG. 4 is a schematic structural diagram of the infant seat assembly and the baby carrier according to an embodiment of the present disclosure.

As shown in FIG. 4, the high chair 2 includes a seat body 21 and a plurality of support brackets 22 for supporting the seat body 21. The seat body 21 includes a carrier base 211, a backrest 212, and two side plates 213. The two side plates 213 are connected to two ends of the backrest 212, respectively, and are connected to the carrier base 211. In this embodiment, the number of the support brackets 22 is four. Specifically, the plurality of support brackets 22 includes two front support brackets 221 and two rear support brackets 222. A front link 223 is provided between the two front support brackets 221, and two ends of the front link 223 are connected to the two front support bracket 221 respectively to increase the support stability of the two front support brackets 221. Similarly, a rear link 224 is provided between the two rear support brackets 222, and two ends of the rear link 224 are respectively connected to the two rear support brackets 222 to increase the support stability of the two rear support brackets 222.

Figure 5:
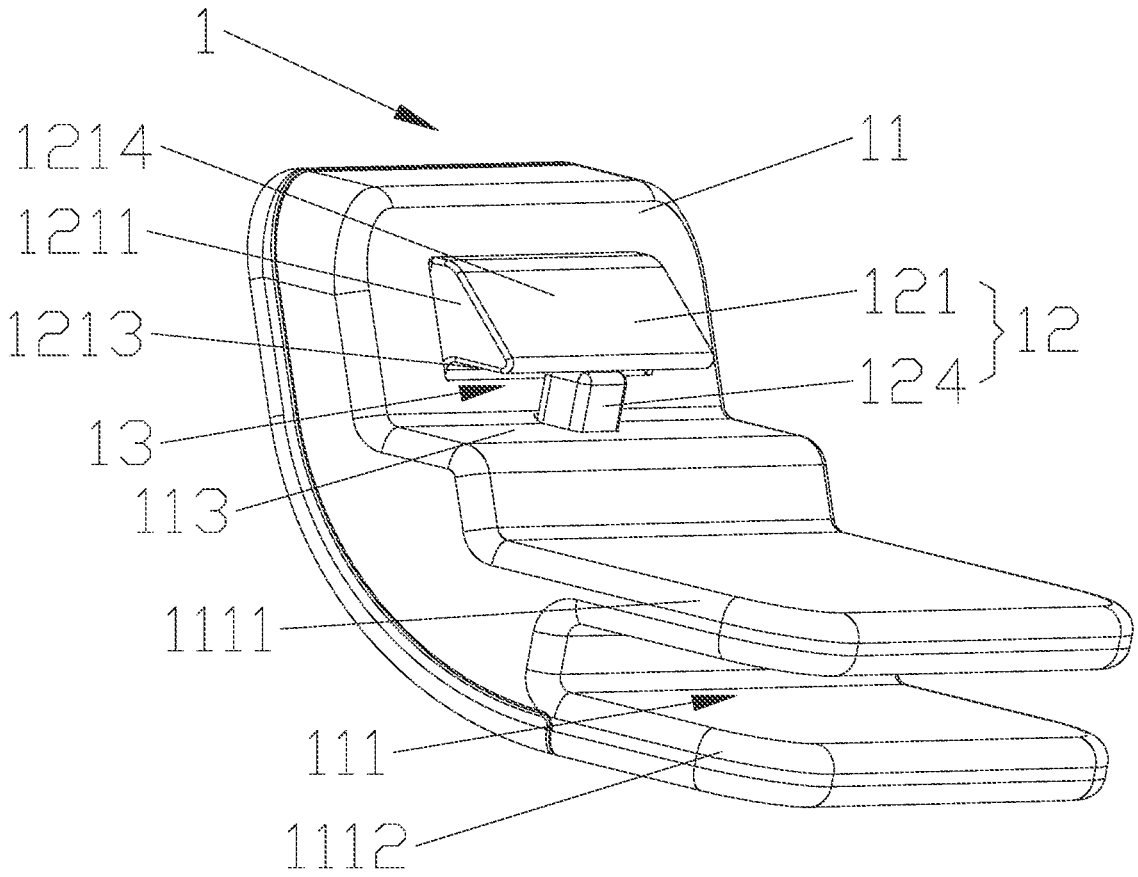
FIG. 5 is a schematic structural diagram of an engaging device according to an embodiment of the present disclosure.

In some embodiments, as shown in FIG. 5, the engaging device 1 includes a first engaging mechanism 12 and an engaging base 11 configured to be connected to the carrier base 211. The baby carrier 9 has a crossbar 91 (see FIG. 4). The first engaging mechanism 12 is movably disposed on the engaging base 11, and the first engaging mechanism 12 is adapted to releasably engage the crossbar 91 with the engaging base 11. The crossbar 91 of the baby carrier 9 connects the engaging device 1 to the carrier base 211 of the high chair 2, so that the baby carrier 9 can be easily and stably fixed to the high chair 2, thereby facilitating the care of the infant by the caregiver during the meal, and also facilitating the infant to have a meal with the caregiver.

Figure 6:
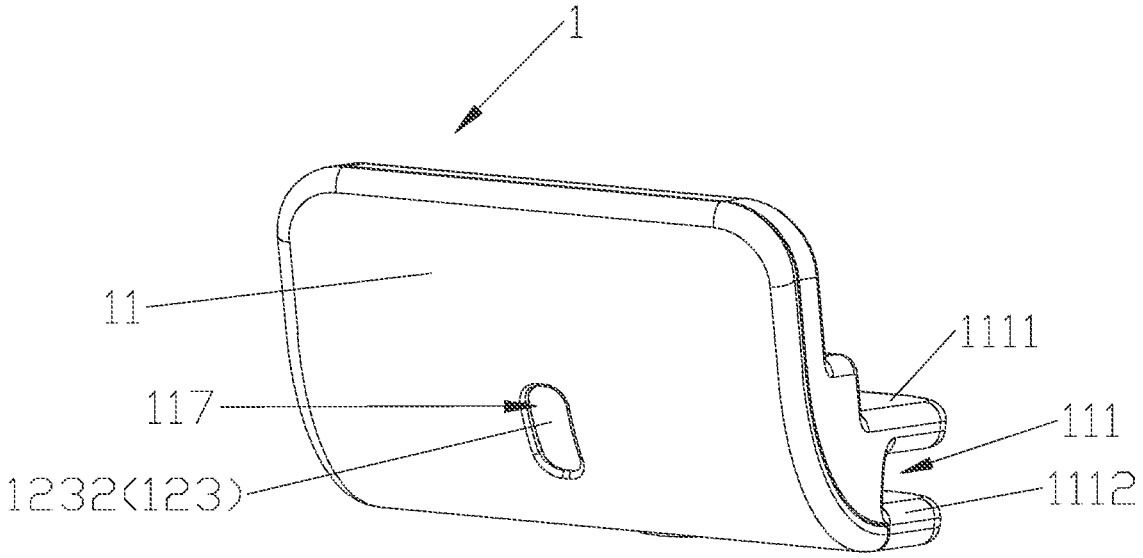
FIG. 6 is a schematic structural diagram of the engaging device in FIG. 5 in another view.
Figure 8:
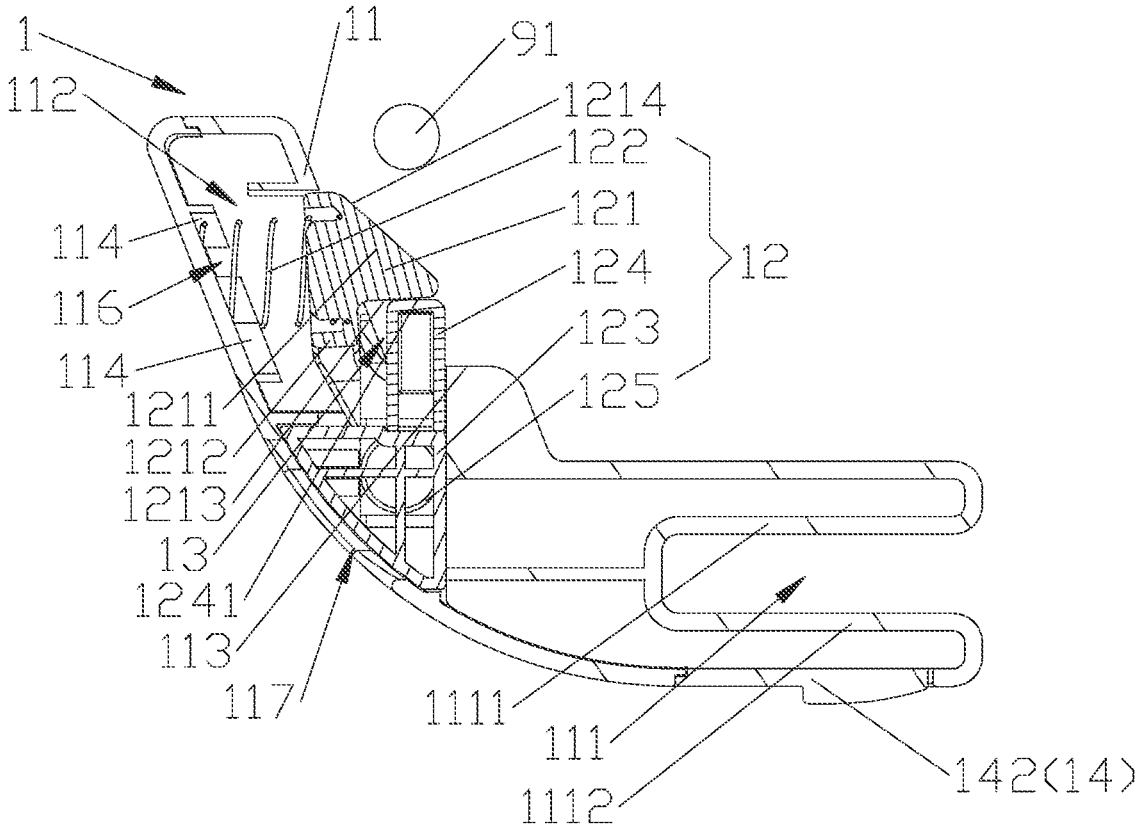
FIG. 8 is a cross-sectional view of the engaging device in FIG. 5 with an unlocking member in a first position and an indication member in a first indication state.
Figure 11:
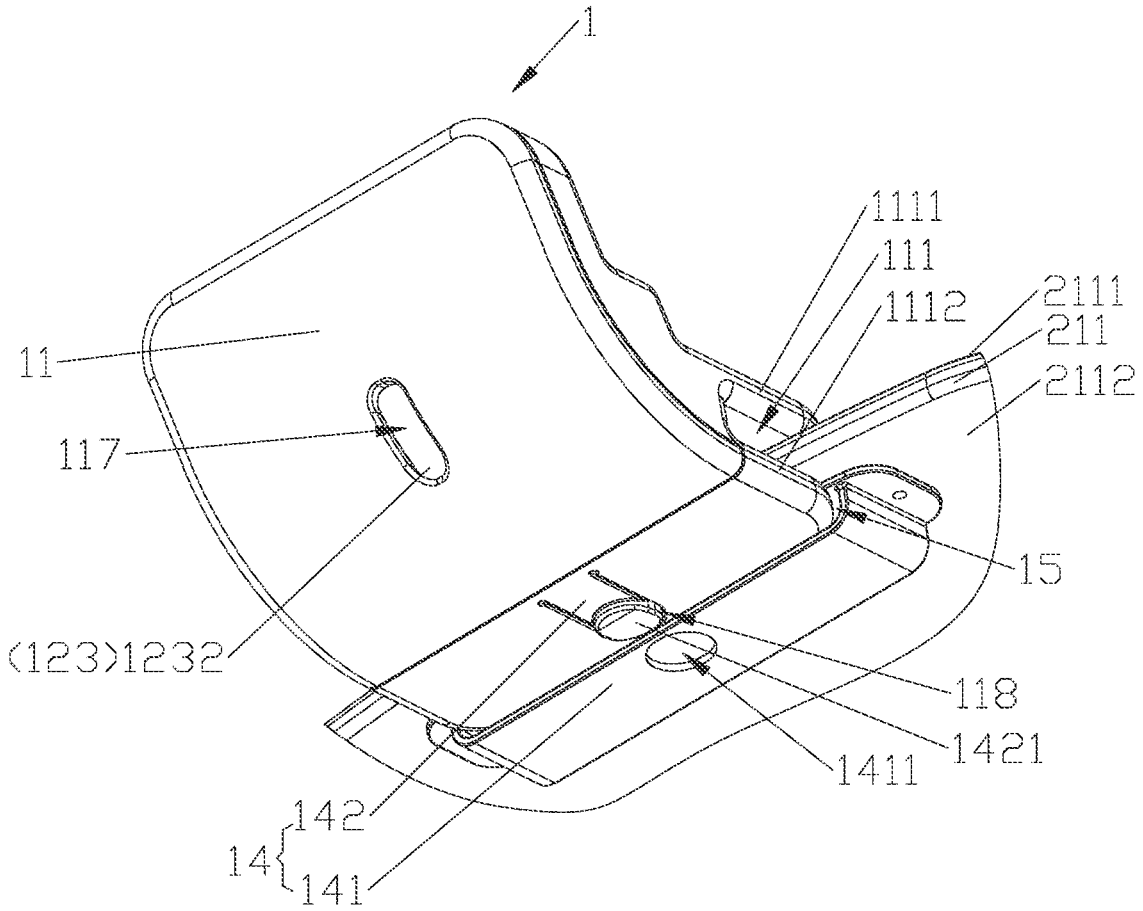
FIG. 11 is a partial schematic diagram of the engaging device connected to carrier base according to an embodiment of the present disclosure.

As shown in FIGS. 5, 6 and 11, the engaging base 11 can be detachably connected to the carrier base 211. The lateral cross-section of the engaging base 11 is generally L-shaped. An end of the engaging base 11 is provided with a clamping slot 111, and a part of the carrier base 211 can be engaged in the clamping slot 111, so that the engaging base 11 can be conveniently fixed to the carrier base 211. The carrier base 211 is in a form of a plate, so as to be engaged in the clamping slot 111. In other embodiments not shown, it is also possible that the carrier base 211 is provided with a clamping slot 111, and an end of the engaging base 11 can be engaged in the clamping slot 111. In other embodiments not shown, an end of the engaging base 11 may also be detachably connected to the carrier base 211 by bolts. Referring to FIG. 8, an accommodating cavity 112 is formed inside the engaging base 11, so that the first engaging mechanism 12 can be partially accommodated in the accommodating cavity 112.

Figure 7:
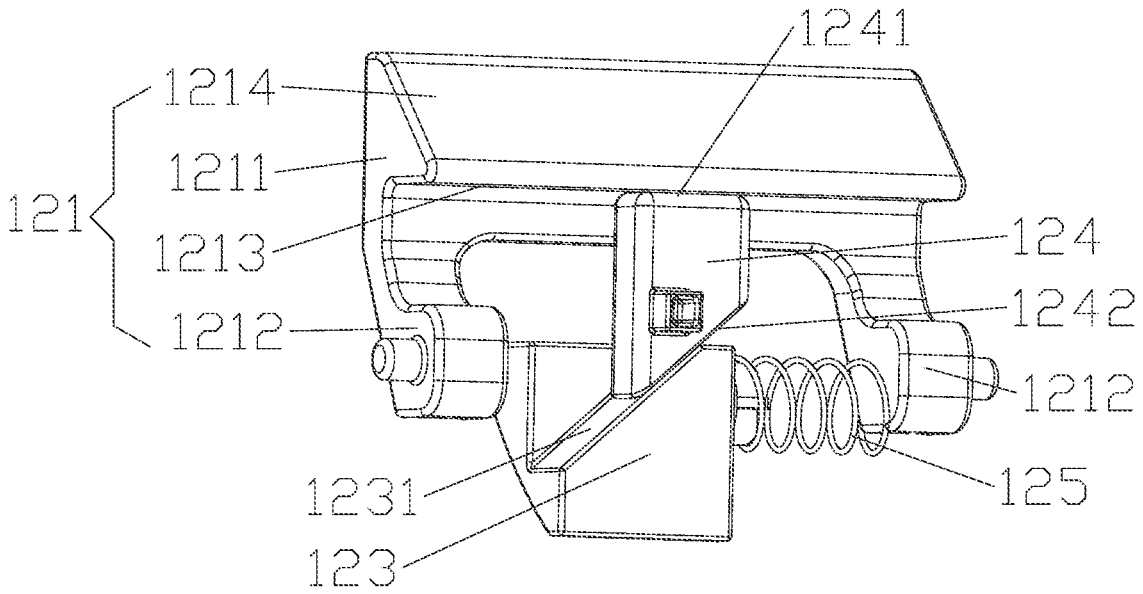
FIG. 7 is a schematic structural diagram of the engaging device of FIG. 5 in yet another view, showing that the engaging base is hidden.
Figure 9:
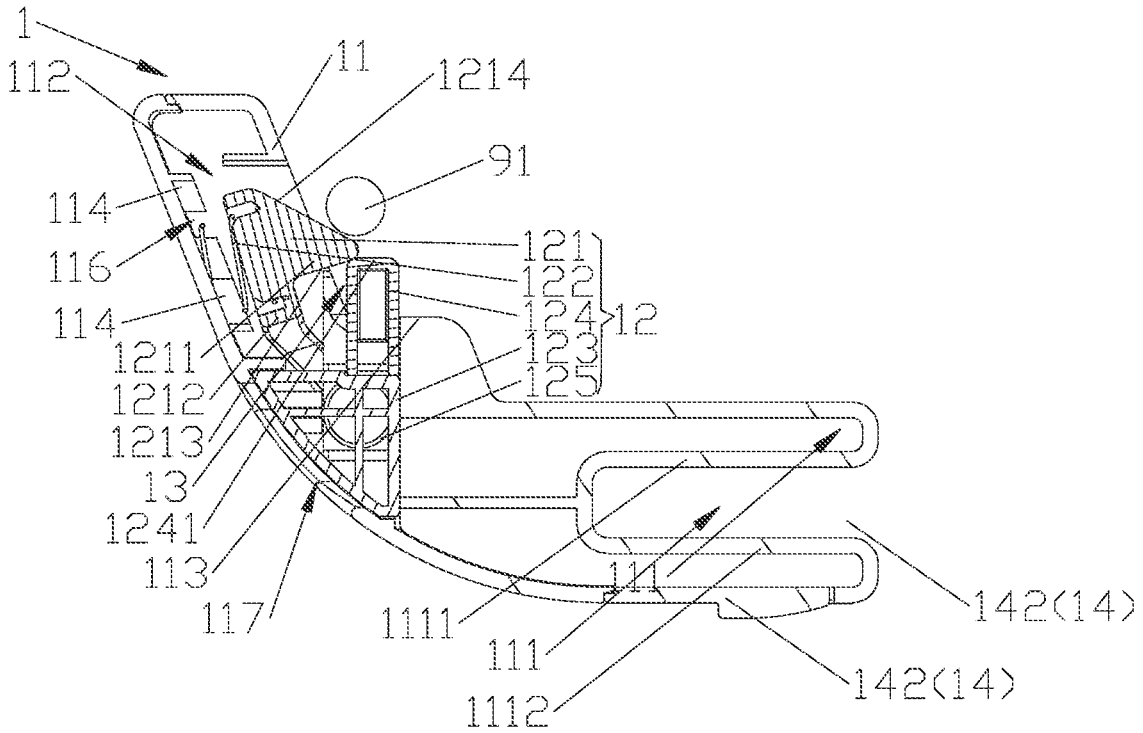
FIG. 9 is a cross-sectional view of the engaging device in FIG. 5 with the unlocking member in a second position and the indication member in the first indicated state.
Figure 10:
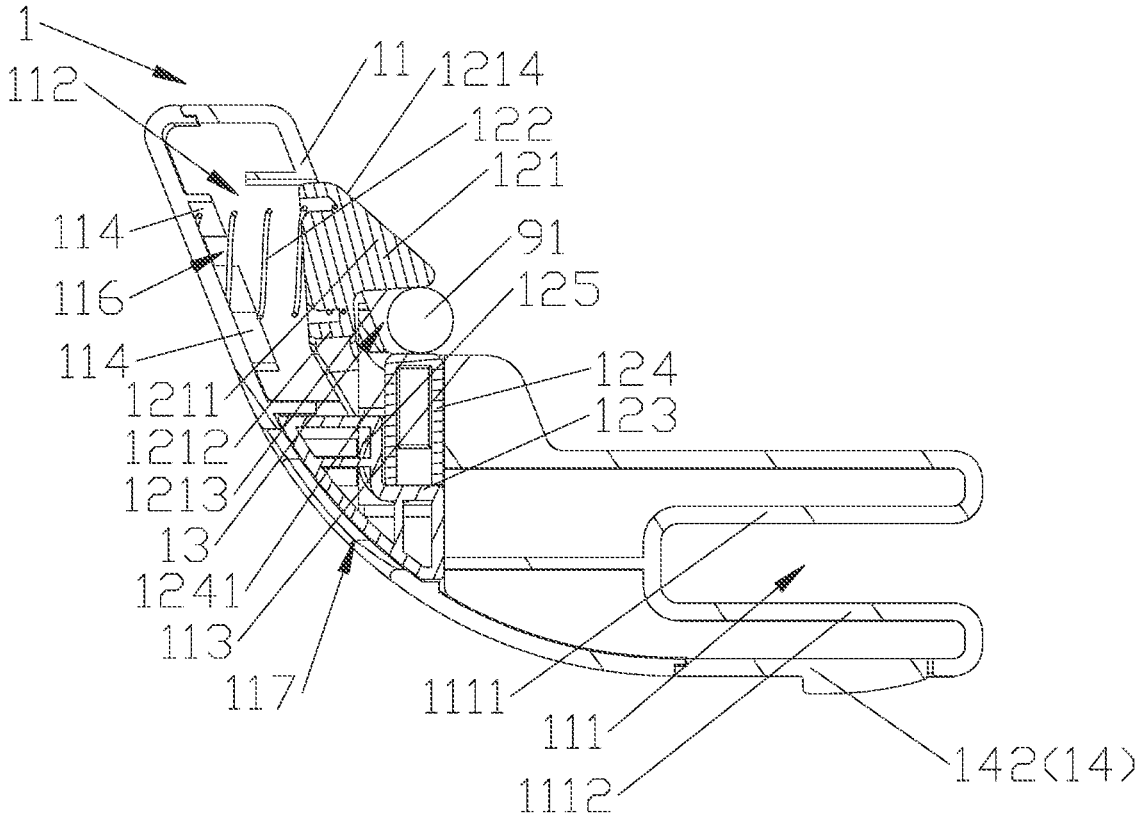
FIG. 10 is a cross-sectional view of the engaging device in FIG. 5 with the unlocking member in the first position and the indication member in a second indication state.

Specifically, as shown in FIGS. 7 to 9, the first engaging mechanism 12 includes an unlocking member 121, a first resilient member 122, an indication member 123, an abutting member 124, and a second resilient member 125. The unlocking member 121 is pivotally connected to the engaging base 11, and the first resilient member 122 is disposed between the unlocking member 121 and the engaging base 11. The unlocking member 121 is switchable between a locked state and an unlocked state. The unlocking member 121 has an engaging portion 1211 and a connecting portion 1212. At least a part of the unlocking member 121 is located within the accommodating cavity 112. The part of the unlocking member 121 located within the accommodating cavity 112 forms a connecting portion 1212, which is pivotally connected to a cavity wall of accommodating cavity 112. When the unlocking member 121 is in the locked state, the engaging portion 1211 is engaged with the crossbar 91, as shown in FIG. 10. When the unlocking member 121 is in the unlocked state, the crossbar 91 is disengaged from the engaging portion 1211, as shown in FIG. 8. In this embodiment, the unlocking member 121 has a first position and a second position. When the unlocking member 121 is in the first position and in the locked state, the unlocking member is adapted to move from the locked state, via the second position, to the unlocked state; and when the unlocking member 121 is in the first position and in the unlocked state, the unlocking member is adapted to move from the unlocked state, via the second position, to the locked state. The second position of the unlocking member 121, as shown in FIG. 9, is a transition position that the unlocking member 121 needs to pass during the mutual switching between the locked state and the unlocked state.

Specifically, the engaging portion 1211 has a first engaging surface 1213 and the engaging base 11 has a second engaging surface 113. When the unlocking member 121 is in the first position, the first engaging surface 1213 is arranged opposite to the second engaging surface 113, and the first engaging surface 1213 and the second engaging surface 113 are enclosed to form an engaging slot 13. The crossbar 91 is adapted to be engaged between the first engaging surface 1213 and the second engaging surface 113, that is, the crossbar 91 is adapted to be engaged in the engaging slot 13. In other embodiments not shown, the engaging portion 1211 may also be provided with a hook portion, which is adapted to be engaged with the crossbar 91 when the unlocking member 121 is in the first position. In the present embodiment, further, the engaging portion 1211 has a wedge surface 1214 which is adapted to be pushed against by the crossbar 91, causing the unlocking member 121 to pivot, and the wedge surface 1214 and the first engaging surface 1213 are connected to each other and angularly arranged. In this way, it is possible to push the unlocking member 121 pivot (see FIG. 9) by wedge surface 1214 in the process of the crossbar 91 approaching the engaging base 11 without manual operation of the unlocking member 121, so that the crossbar 91 is capable of being engaged with the engaging portion 1211.

As shown in FIGS. 8 to 10, the first resilient member 122 is adapted to bias the unlocking member 121 to pivot the unlocking member 121 to a first position (i.e., an initial position). The crossbar 91 pushes against the wedge surface 1214 in the process of the crossbar 91 approaching the engaging base 11, so as to pivot the unlocking member 121 toward the second position. When the crossbar 91 continues to move to the engaging slot 13, the crossbar 91 no longer pushes against the wedge surface 1214, and the unlocking member 121 pivots from the second position to the first position under the elastic force of the first resilient member 122. In this embodiment, the first resilient member 122 includes a spring. The first resilient member 122 is accommodated within the accommodating cavity 112. The cavity wall of the accommodating cavity 112 is provided with a plurality of first projections 114, which are enclosed to form the receiving slot 116. An end of the first resilient member 122 abuts against the unlocking member 121 and another end of the first resilient member 122 is inserted into the receiving slot 116 to avoid deflection of the first resilient member 122 during deformation.

As shown in FIGS. 6 to 8, the indication member 123 is movably disposed at the engaging base 11 and is switchable between at least two indication states to indicate the state of unlocking member 121. At least two indication states include a first indication state for indicating that the crossbar 91 is disengaged from the first engaging mechanism 12 and a second indication state for indicating that the crossbar 91 is engaged with the first engaging mechanism 12. As shown in FIG. 11, the indication member 123 is provided with indication marks 1232 indicating at least two indication states, respectively. The indication marks 1232 includes a red flag to indicate the first indication state and a green flag to indicate the second indication state. Of course, in other embodiments, at least two other different indication marks may be used to indicate at least two states as long as different indication states can be distinguished. In this embodiment, the indication member 123 is disposed in the accommodating cavity 112, and the engaging base 11 is provided with an indication window 117 for displaying any indication mark 1232. Specifically, when the crossbar 91 (see FIG. 4) is disengaged from the engaging portion 1211 (that is, when the crossbar 91 is not engaged with the engaging portion 1211), the indication member 123 is in the first indication state, and a red flag of the indication member 123 is located at the indication window 117. When the crossbar 91 is engaged with the engaging portion 1211, the indication member 123 is switched from the first indication state to the second indication state, at which time the green flag of the indication member 123 is moved to the indication window 117. It is thus convenient for the caregiver to determine whether the baby carrier 9 is engaged with the first engaging mechanism 12 based on the indication mark 1232 shown at indication window 117.

As shown in FIG. 7, the abutting member 124 is movably disposed on the engaging base 11 and between the unlocking member 121 and the indication member 123. As shown in FIGS. 8 to 10, the abutting member 124 is switchable between the extended position and the retracted position, and when the abutting member 124 is switched from the extended position to the retracted position, the abutting member 124 pushes the indication member 123, so that the indication member 123 is switched from the first indication state to the second indication state. An end of abutting member 124 is an abutting end 1241 capable of abutting the crossbar 91. When the abutting member 124 is in the retracted position, as shown in FIG. 9, the abutting end 1241 and the second engaging surface 113 are substantially flush, and the crossbar 91 is capable of being engaged between the first engaging surface 1213 and the abutting end 1241. When the abutting member 124 is in the extended position, as shown in FIG. 8, the crossbar 91 is disengaged from the first engaging surface 1213. The second resilient member 125 is adapted to bias the indication member 123 toward the first indication state. An end of the indication member 123 has a first driving bevel 1231, the other end of the abutting member 124 is provided with a second driving bevel 1242 adapted to abut against the first driving bevel 1231 to drive the indication member 123 to move, so that the indication member 123 switches between at least two indicating states (the first indication state and the second indication state in the present embodiment). When the unlocking member 121 is in the unlocked state in the first position, the abutting end 1241 of the abutting member 124 is located between the first engaging surface 1213 and the second engaging surface 113. In this embodiment, when the unlocking member 121 is in the unlocked state in the first position, the abutting member 124 is disposed substantially perpendicular to the first engaging surface 1213. Of course, in other embodiments, the abutting member 124 may also be staggered from the first engaging surface 1213.

As shown in FIGS. 9 and 10, when the crossbar 91 moves to be engaged with the engaging portion 1211, the crossbar 91 pushes the abutting end 1241 of the abutting member 124 to move the abutting member 124, and drives the indication member 123 to move by the engagement of the second driving bevel 1242 and the first driving bevel 1231, so that the indication member 123 is switched from the first indication state to the second indication state. As shown in FIGS. 8 and 9, when the crossbar 91 is disengaged from the engaging portion 1211, the crossbar 91 no longer pushes against the abutting member 124, the abutting member 124 no longer generates a driving force to the indication member 123, and the indication member 123 moves from the second indication state to the first indication state under the elastic force of the second resilient member 125, and drives the indication member 123 to move by the engagement of the first driving bevel 1231 and the second driving bevel 1242.

Figure 12:
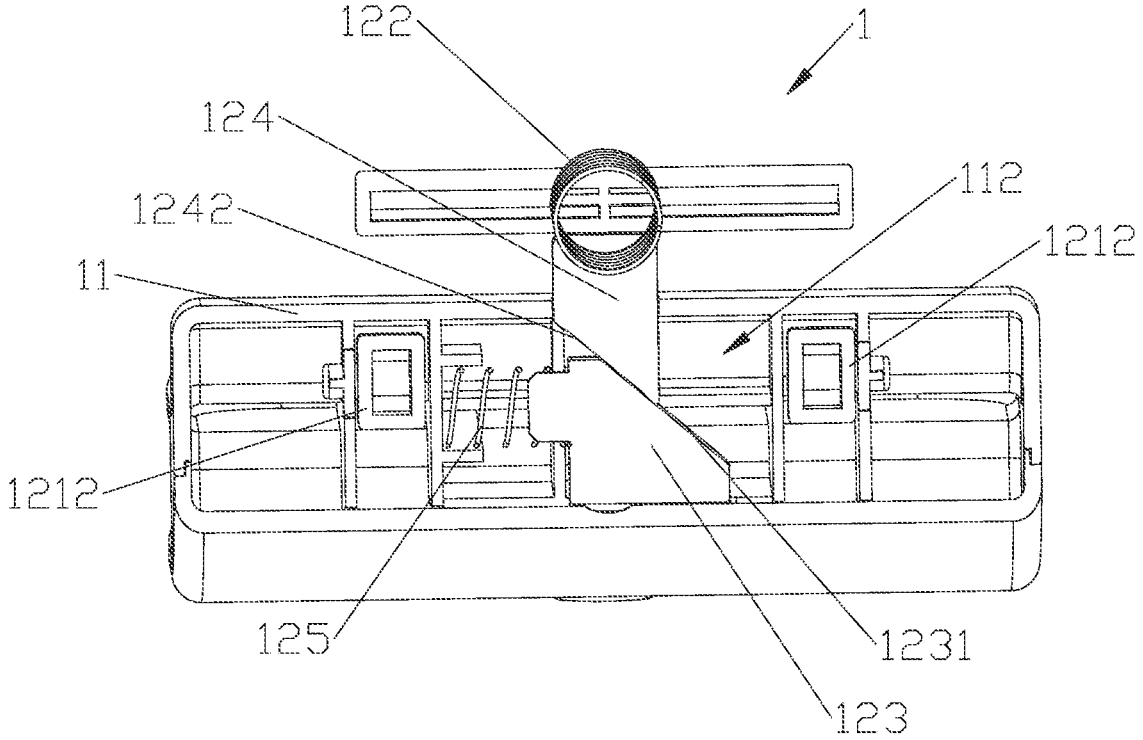
FIG. 12 is a cross-sectional view of the engaging device in FIG. 5 in another view.

Further, as shown in FIGS. 8 and 12, the second resilient member 125 is a spring. The second resilient member 125 is accommodated within the accommodating cavity 112 and is disposed between the inner walls of the indication member 123 and the engaging base 11. the unlocking member 121 is provided with two connecting portions 1212, which are arranged opposite and spaced apart. A part of the indication member 123 and the second resilient member 125 are located between the two connecting portion 1212, and the indication member 123 is movable between the two connecting portions 1212. An end of the second resilient member 125 abuts against the indication member 123, and the other end of the second resilient member 125 abuts against the inner wall of the engaging base 11 to bias the indication member 123 toward one of the two connecting portion 1212.

As shown in FIG. 11, the engaging device 1 further includes a second engaging mechanism 14, which includes an engaging member 141 and a resilient arm 142. The engaging member 141 is connected to the carrier base 211 and forms a mounting groove 15 with the carrier base 211 for insertion of at least part of the engaging base 11. The engaging member 141 is provided with a first engaging hole 1411. A surface of the carrier base 211 for carrying the infant is the first side surface 2111, and a surface of the carrier base 211 facing away from the first side surface 2111 is the second side surface 2112. The engaging member 141 is disposed on the second side surface 2112 of the carrier base 211. Thus, when the high chair 2 is used alone, the engaging member 141 can be detached from the carrier base 211, thereby preventing the engaging member 141 from hindering the use of the high chair 2 by the infant. The resilient arm 142 is connected to the engaging base 11, and the resilient arm 142 is provided with a first engaging projection 1421 capable of being engaged with the first engaging hole 1411. Specifically, the engaging base 11 has an opening groove 118. An end of the resilient arm 142 is connected to the groove wall of the opening groove 118, and another end of the resilient arm 142 is provided with a first engaging projection 1421. The first engaging projection 1421 has an engaged position, in which the first engaging projection 1421 protrudes from the opening groove 118, and a retracted position, in which the first engaging projection 1421 does not protrude from the opening groove 118. When the first engaging projection 1421 is in the engaged position, the first engaging projection 1421 is adapted to be engaged with the first engaging hole 1411. During insertion of the engaging base 11 into the mounting groove 15, the engaging member 141 is capable of pushing against the first engaging projection 1421, so that the first engaging projection 1421 moves to the retracted position, in this case, the resilient arm 142 is elastically deformed. The resilient arm 142 is adapted to bias the first engaging projection 1421 to move the first engaging projection 1421 to the engaged position, so that after the engaging base 11 is inserted into the mounting groove 15 in place, the first engaging projection 1421 is capable of being engaged with the first engaging hole 1411 under the elastic deformation of the resilient arm 142. In this embodiment, the clamping slot 111 includes a first side wall 1112 and a second side wall 1111. The second side wall 1111 is adapted to abut against the first side surface 2111, and the first side wall 1112 is adapted to abut against the second side surface 2112. The resilient arm 142 is provided on the first side wall 1112. When at least a part of the carrier base 211 is engaged with the clamping slot 111, at least a part of the second side wall 1112 is inserted into the mounting groove 15, the resilient arm 142 enters the mounting groove 15, and the first engaging projection 1421 is engaged with the first engaging hole 1411. By providing the second engaging mechanism 14, it is possible to more firmly connect the engaging base 11 to the carrier base 211, and it is also possible to quickly fix the engaging base 11 to the carrier base 211.

In this embodiment, a specific process of fixedly connecting the engaging device 1 to the baby carrier 9 and the high chair 2, respectively, is as follows:

First, as shown in FIG. 11, after the engaging member 141 is fixed to the carrier base 211, the carrier base 211 is engaged in the clamping slot 111. At this time, as the second side wall 1112 is inserted into the mounting groove 15, the first engaging projection 1421 is engaged in the first engaging hole 1411, so that the engaging device 1 is fixedly connected to the high chair 2.

Next, as shown in FIG. 9, the baby carrier 9 is moved toward the carrier base 211, and the crossbar 91 pushes against the wedge surface 1214 of the unlocking member 121 and thus pivots the unlocking member 121 to the second position as the baby carrier 9 approaches the first engaging mechanism 12. Continuing to move the baby carrier 9 toward carrier base 211, the crossbar 91 remains abutting against the unlocking member 121 such that the unlocking member 121 remains in the second position while the crossbar 91 pushing the abutting member 124 to move and drives the indication member 123 from the first indication state to the second indication state by the engagement of the second driving bevel 1242 with the first driving bevel 1231. When the crossbar 91 moves along the wedge surface 1214 to the engaging slot 15, the crossbar 91 drives the indication member 123 to move to the second indication state through the abutting member 124, and the crossbar 91 no longer abuts against the wedge surface 1214. As shown in FIG. 10, when the unlocking member 121 is pivoted from the second position to the first position under the elastic force of the first resilient member 122, the first engaging surface 1213 is engaged with the crossbar 91, and the unlocking member 121 is in the locked state, so that the crossbar 91 is engaged between the engaging portion 1211 and the abutting member 124.

The process for disconnecting the engaging device 1 from the baby carrier 9 and the high chair 2 respectively is as follows:

First, as shown in FIG. 10, an external force may be applied to the unlocking member 121 so that it pivots from the first position to the second position, so that the crossbar 91 and the unlocking member 121 are disengaged, thereby disconnecting the baby carrier 9 and the engaging device 1, as shown in FIG. 9. When the crossbar 91 is disengaged from the engaging device 1 and the external force applied to the unlocking member 121 is removed, the unlocking member 121 returns from the second position to the first position, that is, the unlocking member 121 returns to the unlocked state (in this case, the unlocking member 121 is in the unlocked state) under the elastic force of the first resilient member 122, as shown in FIG. 8. At the same time, under the elastic force of the second resilient member 125, the indication member 123 moves from the second indication state to the first indication state, and under the engagement of the first driving bevel 1231 and the second driving bevel 1242, the abutting member 124 is driven to move in a direction close to the first engaging surface 1213 until the abutting end 1241 abuts against the first engaging surface 1213, that is, the abutting member 124 moves to the extended position. In other embodiments, when the abutting member 124 is in the extended position, the abutting end 1241 may not abut against the first engaging surface 1213, that is, the abutting end 1241 and the first engaging surface 1213 may be spaced apart.

Next, as shown in FIG. 11, the first engaging projection 1421 may exit the first engaging hole 1411 by pressing. When the first engaging projection 1421 exits the first engaging hole 1411, the clamping slot 111 can be disengaged from the carrier base 211 by an external force applied to the engaging base 11, thereby disconnecting the engaging base 11 and the carrier base 211.

Figure 13:
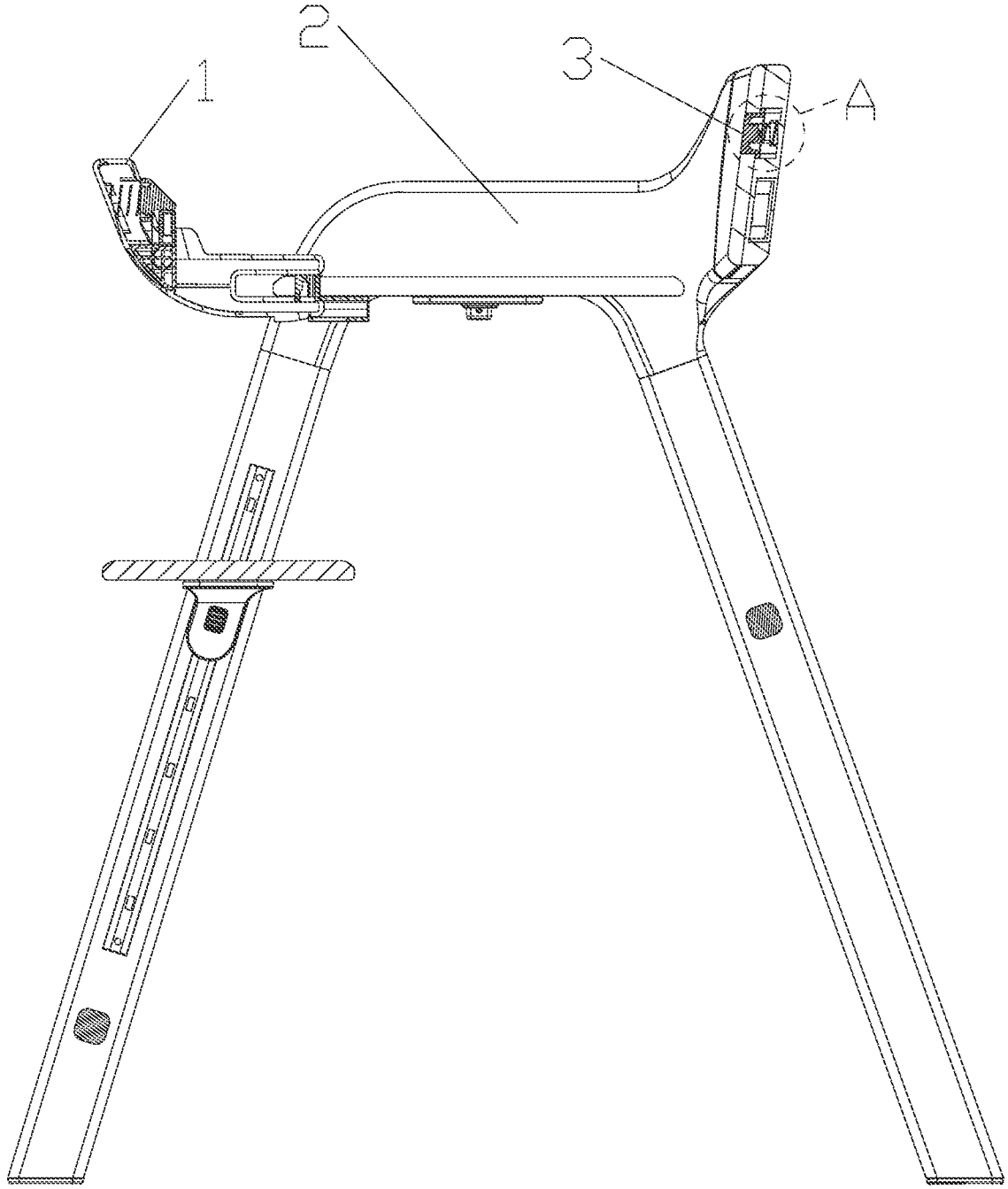
FIG. 13 is a cross-sectional view of the infant seat assembly of FIG. 4.
Figure 14:
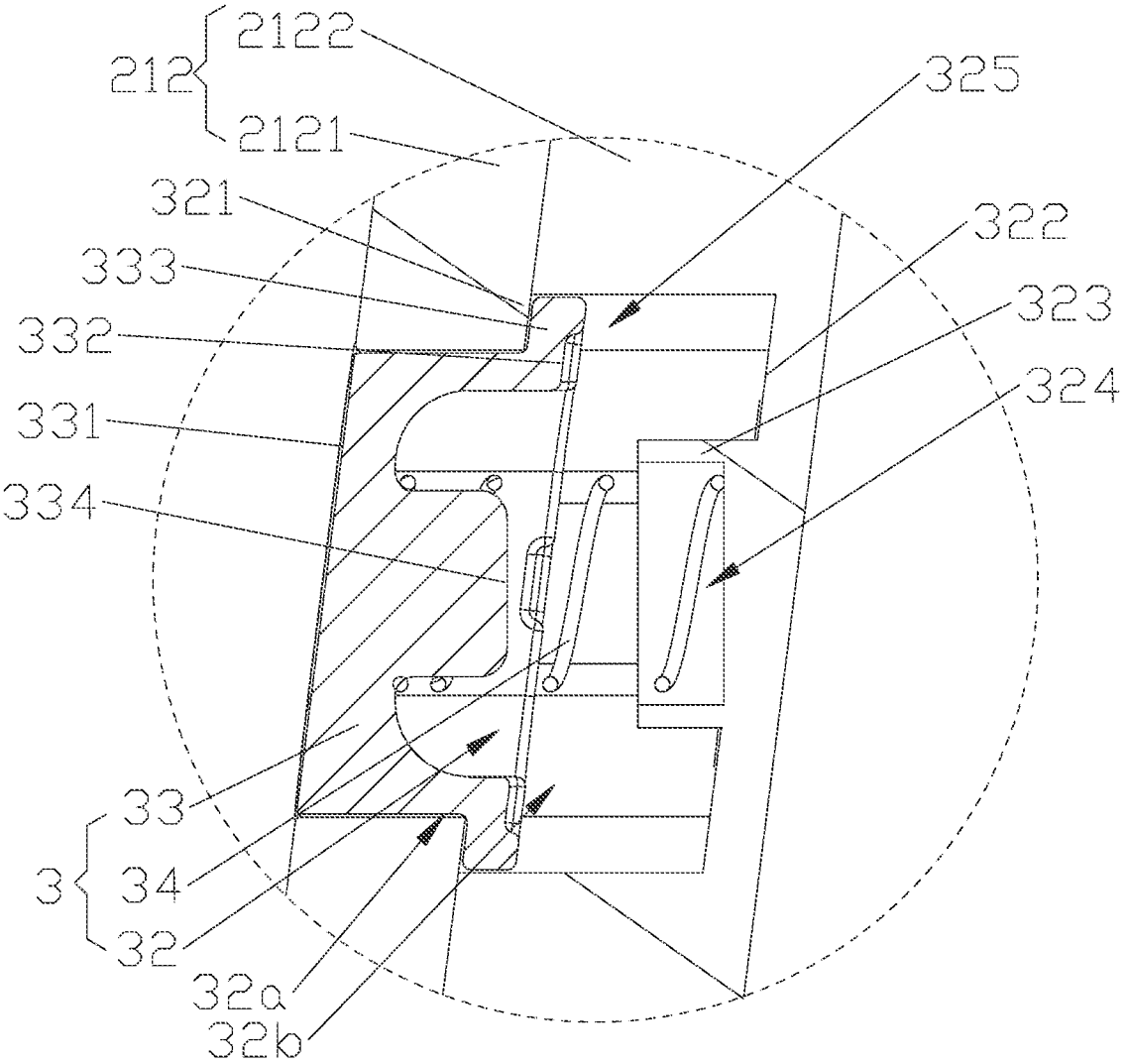
FIG. 14 is an enlarged view of portion A in FIG. 13 with decorative cover in a third position.
Figure 15:
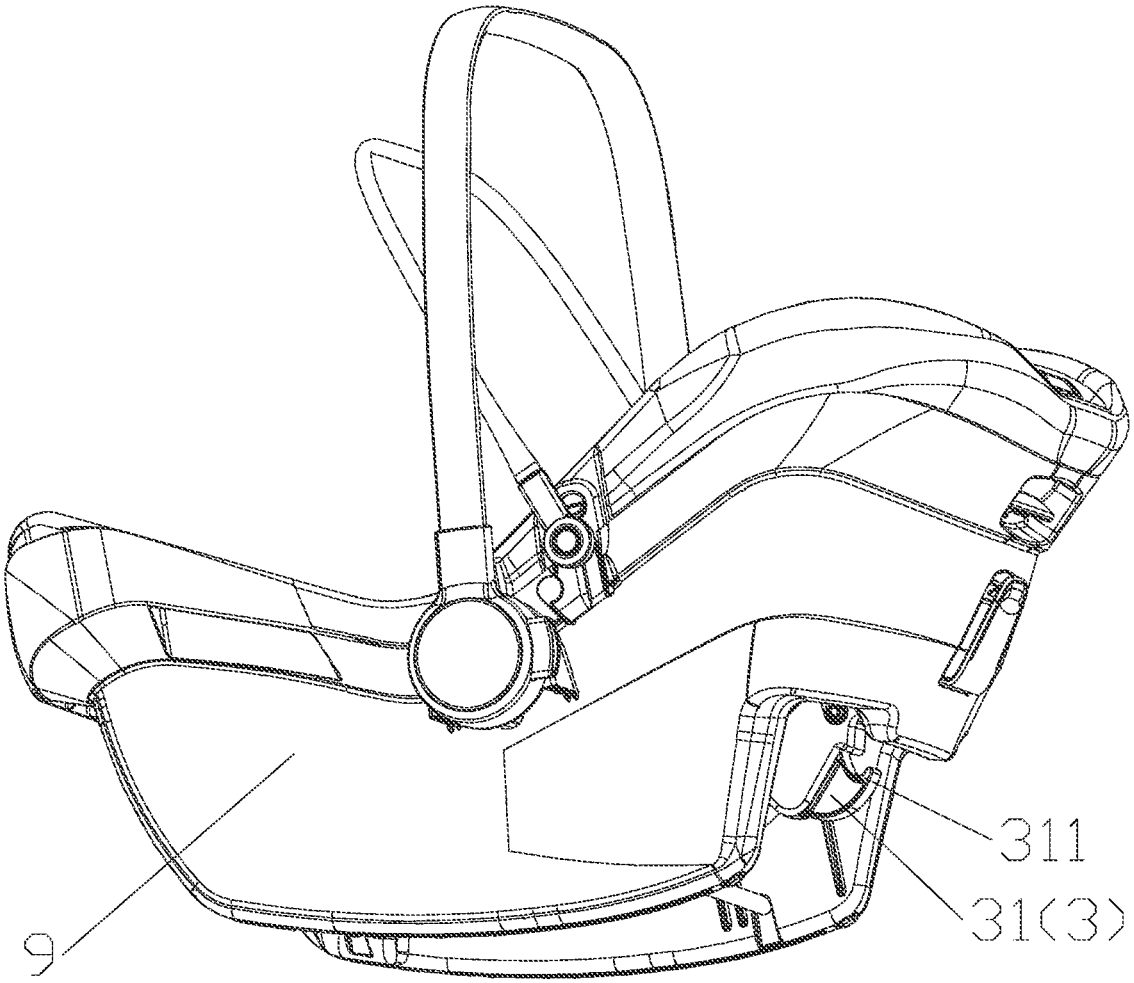
FIG. 15 is a schematic structural diagram of the baby carrier in FIG. 4 in another view.

In some embodiments, as shown in FIGS. 13 to 15, the infant seat assembly may also include a third engaging mechanism 3, through which the baby carrier 9 can be detachably connected to the backrest 212. In this embodiment, the third engaging mechanism 3 includes an engaging groove 32, a locking hook member 31, a decorative cover 33, and a third resilient member 34. The engaging groove 32 is disposed on the backrest 212. A side wall of the engaging groove 32 is provided with a first protruding portion 321, which is spaced apart from a bottom wall 322 of the engaging groove 32 to form a locking hook groove 325. The locking hook member 31 is disposed at the baby carrier 9. The locking hook member 31 has a hook body 311 adapted to be engaged in the locking hook groove 325 to fix the locking hook member 31 in the engaging groove 32. Specifically, the locking hook member 31 and the crossbar 91 are disposed on a front side and a rear side of the baby carrier 9, respectively. For example, the crossbar 91 is disposed on the front side of the baby carrier 9, and the locking hook member 31 is disposed on the rear side of the baby carrier 9.

Further, as shown in FIG. 14, the backrest 212 includes a first back plate 2121 and a second back plate 2122 connected to each other. The engaging groove 32 includes a first hole portion **32*a* disposed on the first back plate 2121 and a second hole portion 32*b* disposed on the second back plate 2122. A bottom wall 322 of the second hole portion 32*b* forms a bottom wall of the engaging groove 32. A sidewall of the first hole portion 32*a* protrudes from a sidewall of the second hole portion 32*b*, so as to form a first protruding portion 321**.

Further, as shown in FIG. 14, the decorative cover 33 is movably provided in the engaging groove 32, and when the hook body 311 (see FIG. 15) is not engaged in the locking hook groove 325, the decorative cover 33 is capable of closing a notch of the engaging groove 32. The decorative cover 33 has a first end 331 away from the bottom wall 322 of the engaging groove 32 and a second end 332 facing toward the bottom wall 322 of the engaging groove 32. The second end 332 is provided with a second protruding portion 333 located between the bottom wall 322 and the first protruding portion 321 of the engaging groove 32. The second protruding portion 333 is adapted to abut against the first protruding portion 321 to limit the decorative cover 33 within the engaging groove 32. In the present embodiment, the decorative cover 33 is an integral molding member. The first protruding portion 321 is formed by connecting the first back plate 2121 to the second back plate 2122, so that the decorative cover 33 can be conveniently mounted in the engaging groove 32.

Further, the decorative cover 33 is switchable between a third position and a fourth position. When decorative cover 33 is in the third position, the second protruding portion 333 abuts against the first protruding portion 321, and the first end 331 is flush with a surface of backrest 212 to cover the notch of the engaging groove 32. In this way, on the one hand, external objects can be prevented from falling into the engaging groove 32, on the other hand, the appearance of the high chair 2 can be made neater and more beautiful, and the entrapment can be avoided. When the decorative cover 33 is in the fourth position, the first end 331 and the first protruding portion 321 are spaced apart so that the hook body 311 is capable of being engaged in the locking hook groove 325, thereby enabling the baby carrier 9 to be fixedly connected to the backrest 212.

As shown in FIG. 14, the third resilient member 34 is disposed between the bottom wall 322 of the engaging groove 32 and the decorative cover 33, and the third resilient member 34 is adapted to bias the decorative cover 33, so that the decorative cover 33 moves to the third position. The third resilient member 34 includes a spring. Specifically, the bottom wall 322 of the engaging groove 32 may be provided with a third protruding portion 323, which is provided with a receiving hole 324. The decorative cover 33 may have a fourth protruding portion 334 disposed facing toward the receiving hole 324. An end of the third resilient member 34 is sleeved on the third protruding portion 323, and another end of the third resilient member 34 is inserted into the receiving hole 324 to prevent the third resilient member 34 from shifting during deformation.

Figure 16:
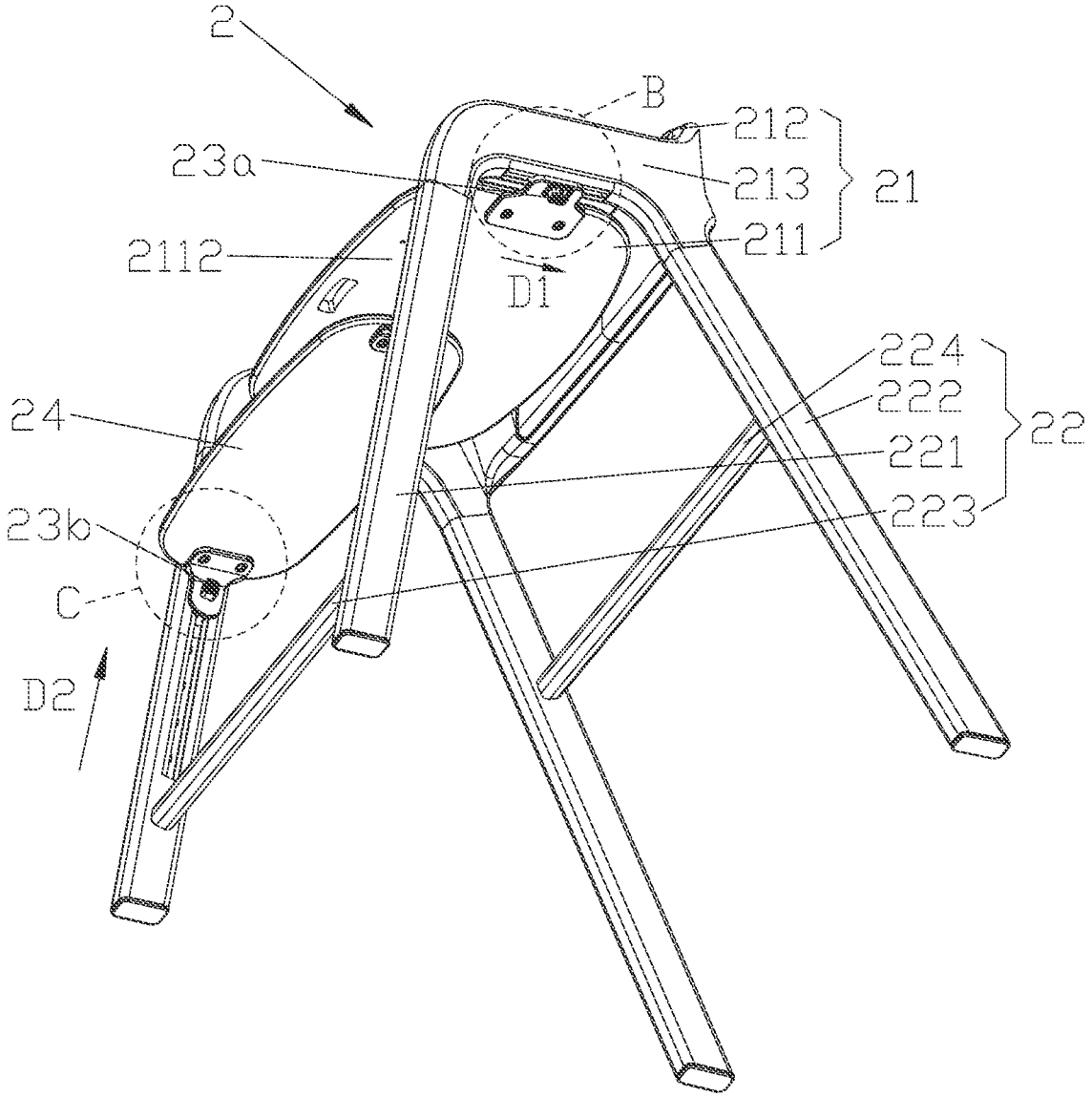
FIG. 16 is a schematic structural diagram of a high chair according to an embodiment of the present disclosure.

In some embodiments, as shown in FIG. 16, the high chair 2 has a first component and a second component that are relatively movable, and adjusting mechanisms 23*a*, 23*b* connected to the first component and the second component, respectively. The adjusting mechanisms 23*a*, 23*b* are switchable between a locked state and an unlocked state. When the adjusting mechanisms 23*a*, 23*b* are in the unlocked state, the first component is movable relative to the second component in predetermined directions D1, D2. When the adjusting mechanisms 23*a*, 23*b* are in the locked state, the first component is fixed relative to the second component.

Referring to FIG. 16, the first component may be the carrier base 211 and the second component may be the side plate 213. The predetermined direction is a direction D1 or a reverse direction of the direction D1 in which the carrier base 211 is away from or close to the backrest 212, that is, the front-rear direction in FIG. 16. The adjusting mechanism may include a first adjusting mechanism 23*a*. The carrier base 211 are connected to the two side plates 213 through the two first adjusting mechanisms 23*a*, respectively, and movable through the first adjusting mechanism 23*a* in the direction D1 or in the reverse direction of the direction D1.

Figure 17:
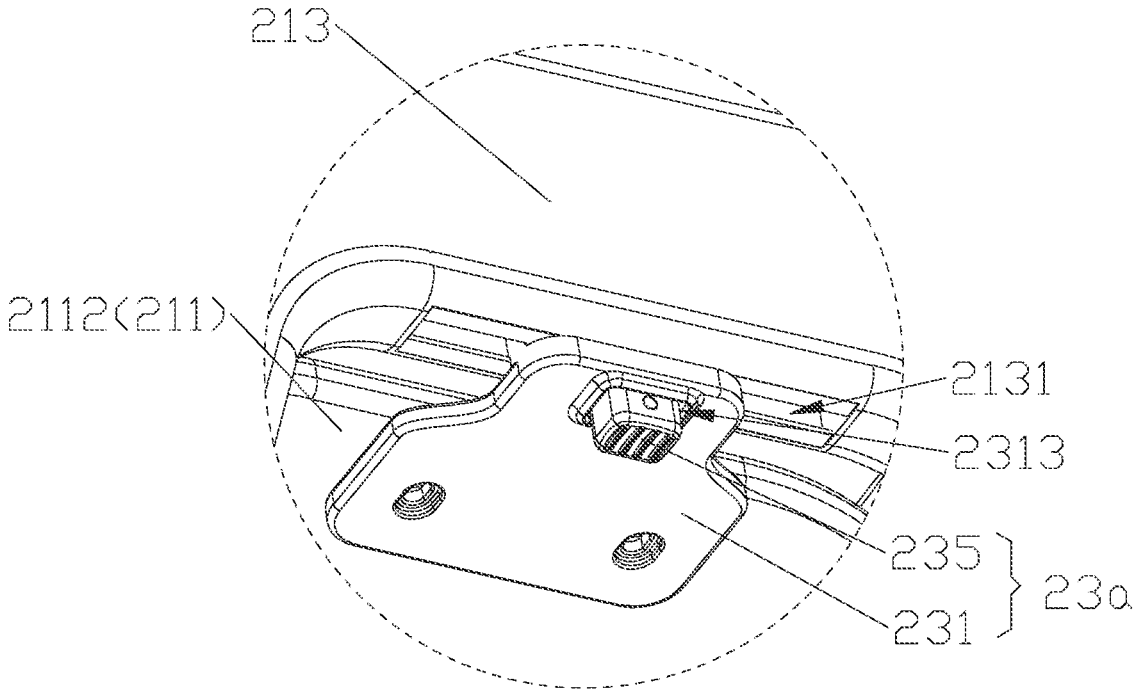
FIG. 17 is an enlarged view of portion B in FIG. 16.
Figure 18:
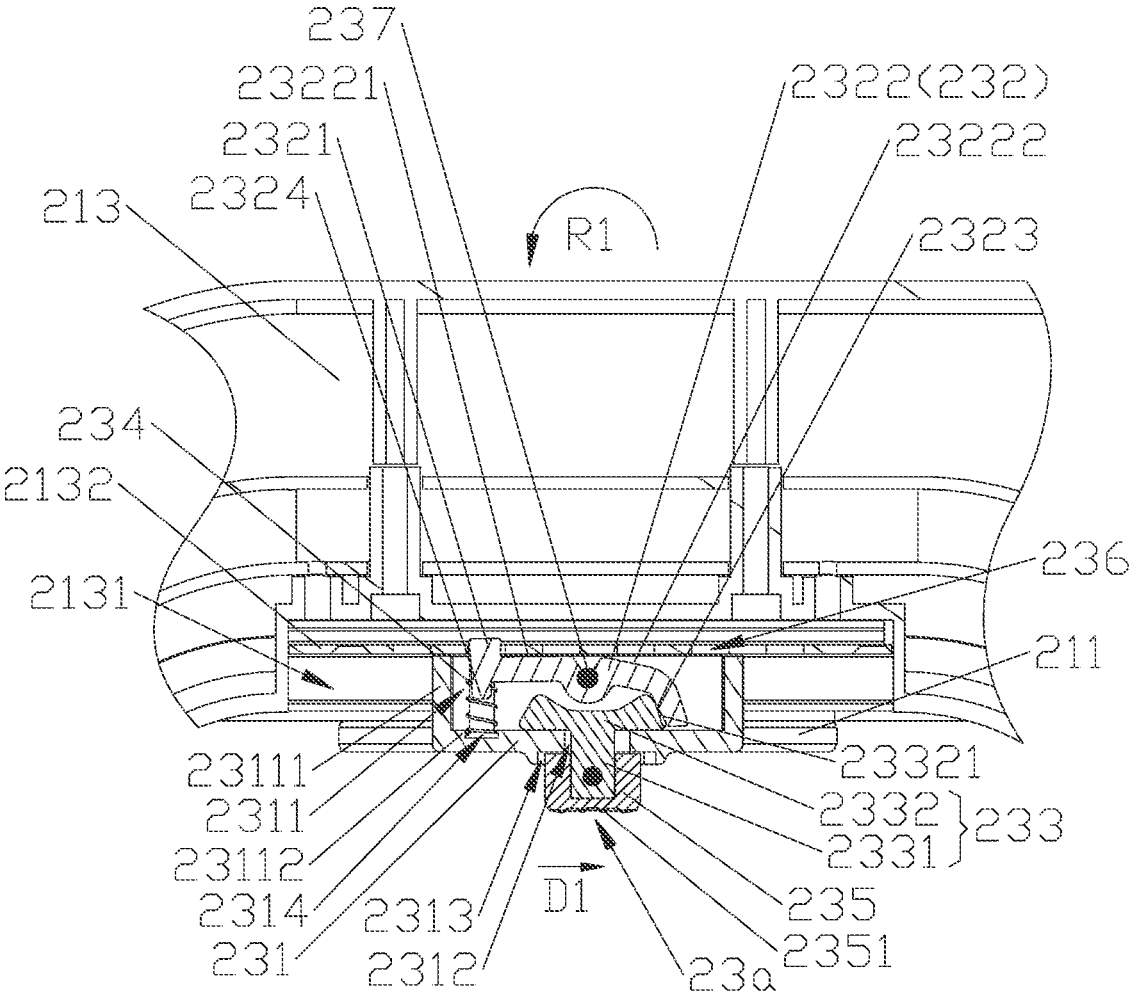
FIG. 18 is a partial cross-sectional view of a first adjusting mechanism of the high chair according to an embodiment of the present disclosure, showing the first adjusting mechanism at a locked state.
Figure 19:
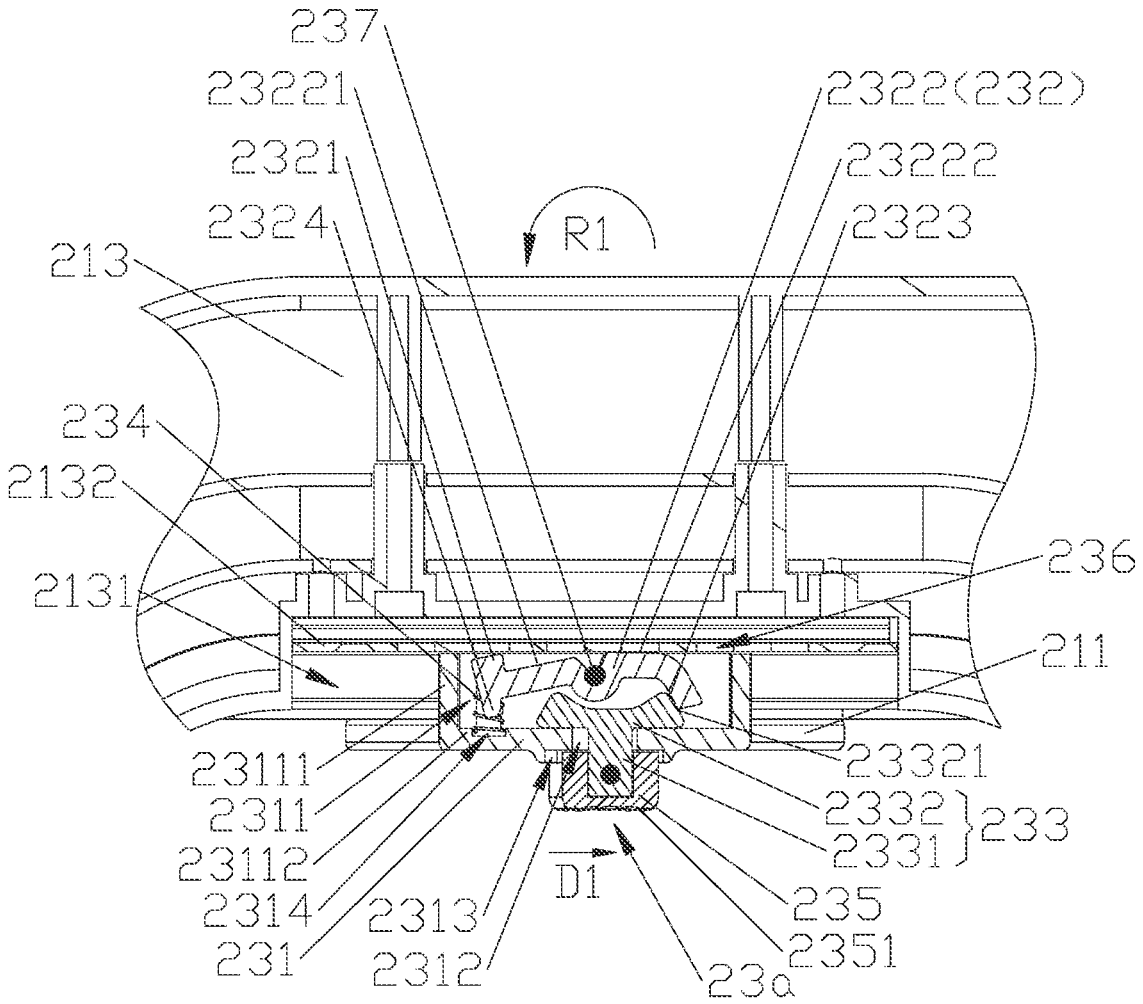
FIG. 19 is a partial cross-sectional view of the first adjusting mechanism of the high chair in FIG. 18, showing the first adjusting mechanism in an unlocked state.

As shown in FIGS. 17 to 19, the first adjusting mechanism 23*a* includes a connecting base 231, a locking member 232, a driving member 233, a fourth resetting member 234, an operating member 235, and a plurality of locking holes 236. The operating member 235 abuts against the locking member 232 through the driving member 233 and drives the locking member 232 to move through the driving member 233. The fourth resetting member 234 is adapted to bias the locking member 232, so that the locking member 232 returns to an initial position.

Referring to FIGS. 18 and 19, a plurality of locking hole 236 are disposed in one of carrier base 211 (i.e., a first component) and the side plate 213 (i.e., a second component) and arranged in the direction D1. The locking member 232 is movably connected to another of the carrier base 211 (i.e., the first component) and the side plate 213 (i.e., the second component). Specifically, the locking member 232 is pivotally connected to the other of the carrier base 211 and the side plate 213. In this embodiment, a plurality of locking holes 236 are disposed on the side plate 213. The locking member 232 is pivotally connected to the carrier base 211. The locking member 232 is capable of being inserted into at least one of the plurality of locking holes 236 to releasably and securely connect the carrier base 211 to the side plate 213. A first strip groove 2131 is also disposed on the side plate 213. A plurality of locking holes 236 are disposed on a bottom wall of the first strip groove 2131 and in communication with the first strip groove 2131. A first strip block 2132 is disposed in the first strip groove 2131, the first strip block 2132 is fixed to the bottom wall of the first strip groove 2131, and the plurality of locking holes 236 are evenly distributed on the first strip block 2132. The first strip block 2132 having the locking hole 236 is provided in the first strip groove 2131, so that manufacturing can be facilitated.

Further, an end of the connecting base 231 is movably connected to one of the carrier base 211 and the side plate 213, and the connecting base 231 is fixed to another of the carrier base 211 and the side plate 213. In this embodiment, the connecting base 231 is movably connected to the side plate 213 and fixedly connected to the carrier base 211. Specifically, the connecting base 231 is fixedly connected to the second side surface 2112 of the carrier base 211 (see FIG. 16) to avoid obstructing the infant's ride. An end of the connecting base 231 away from the carrier base 211 is movably connected to the side plate 213. The connecting base 231 and the carrier base 211 are capable of moving relative to the side plate 213. As shown in FIGS. 18 and 19, the connecting base 231 has an accommodating groove 2311 for accommodating the locking member 232. The accommodating groove 2311 has a side wall 23111 and a bottom wall 23112. The bottom wall 23112 of accommodating groove 2311 is arranged opposite to the bottom wall of first strip groove 2131. At least a part of the side wall 23111 of the accommodating groove 2311 is accommodated within the first strip groove 2131 and is movable along the first strip groove 2131. The bottom wall 23112 of the accommodating groove 2311 is provided with a strip hole 2312 for the driving member 233 to pass out.

Specifically, as shown in FIGS. 18 and 19, the locking member 232 includes a locking portion 2321 and a locking body 2322. The locking body 2322 is pivotally connected to the connecting base 231 by a pivot shaft 237. The locking portion 2321 is disposed at an end of the locking body 2322. In this embodiment, the locking member 232 is accommodated in the accommodating groove 2311 and is pivotally connected to the side wall 23111 of the accommodating groove 2311 through the pivot shaft 237. The locking member 232 is switchable between a locked position and an unlocked position. When the locking member 232 is in the locked position, as shown in FIG. 18, the locking portion 2321 is capable of extending out of a notch of the accommodating groove 2331 and being inserted into any of the locking holes 236. When the locking member 232 is in the unlocked position, as shown in FIG. 19, the locking portion 2321 is disengaged from any of the locking holes 236, i.e., the locking portion 2321 exits any of the locking holes 236. The locking body 2322 is operable to switch the locking portion 2321 between the locked position and the unlocked position. The fourth resetting member 234 is adapted to bias the locking member 232 to pivot to the locked position.

As shown in FIGS. 18 and 19, the driving member 233 includes a driving portion 2332 and an operating portion 2331, and driving portion 2332 abuts against the locking body 2322. The operating portion 2331 extends out of the connecting base 231 through the strip hole 2312 to be operated. The operating portion 2331 is operable to make the driving portion 2332 push the locking body 2322 to pivot, so as to drive the locking member 232 to switch between the locked position and the unlocked position. The operating portion 2331 is movable along the strip hole 2312 and the hole wall of the strip hole 2312 is adapted to abut against the operating portion 2331 to limit the move stroke of the driving member 233. In this embodiment, a moving direction of the operating portion 2331 is parallel to the direction D1.

Further, as shown in FIGS. 18 and 19, the driving portion 2332 has a first abutting bevel 23321, and the locking body 2322 is provided with a second abutting bevel 2323 arranged opposite to the first abutting bevel 23321. The second abutting bevel 2323 and the locking portion 2321 are located on two sides of pivot shaft 237, respectively. When the operating portion 2331 is pushed to move, the driving portion 2332 follows the operating portion 2331 and pushes against the second abutting bevel 2323 through the first abutting bevel 23321, driving the locking member 232 to pivot about the pivot shaft 237. The first abutting bevel 23321 is disposed at an angle to the moving direction of the operating portion 2331 and is not perpendicular to the moving direction of the operating portion 2331. The moving direction of the operating portion 2331 is parallel to the direction D1.

Further, as shown in FIGS. 18 and 19, a first limiting surface 23221 and a second limiting surface 23222 are formed on a side of the locking body 2322 facing toward the locking hole 236. The first limiting surface 23221 and the locking portion 2321 are located on one side of pivot shaft 237, and the second abutting bevel 2323 and the second limiting surface 23222 are located on the other side of the pivot shaft 237. The first limiting surface 23221 and the second limiting surface 23222 are arranged at a certain angle, and the specific angle can be set according to actual requirements. The locking portion 2321 protrudes from the first limiting surface 23221 so that the locking portion 2321 is capable of extending into the locking hole 236. When the locking member 232 is in the locked position, the first limiting surface 23221 abuts against the first strip block 2132 to prevent excessive pivoting of the locking member 232. When the locking member 232 is at the unlocked position, the second limiting surface 23222 abuts against the first strip block 2132 to prevent excessive pivoting of the locking member 232. The locking member 232 also includes a projecting portion 2324 for mounting the fourth resetting member 234. The projecting portion 2324 is disposed at an end of the locking body 2322 and is disposed opposite to the locking portion 2321. Specifically, the projecting portion 2324 extends away from the locking portion 2321, that is, the projecting portion 2324 extends toward the bottom wall 23112 of the accommodating groove 2311.

As shown in FIGS. 18 and 19, the fourth resetting member 234 includes a spring and is accommodated within the accommodating groove 2311. The bottom wall 23112 of the accommodating groove 2311 is provided with a recess 2314. An end of the fourth resetting member 234 is inserted into the recess 2314 and the other end of the fourth resetting member 234 is inserted into the projecting portion 2324 to avoid the fourth resetting member 234 offset during pivoting of the locking member 232.

As shown in FIGS. 18 and 19, the operating member 235 is fixed to an end of the operating portion 2331 away from the driving portion 2332, and the operating member 235 is adapted to be operated. The operating member 235 is capable of being moved to drive the driving member 233 to move, thereby driving the locking member 232 to pivot. The connecting base 231 is provided with a guide groove 2313. A part of the operating member 235 is accommodated in the guide groove 2313 and movable along the guide groove 2313. The guide groove 2313 is in communication with the strip hole 2312 and extending in a direction parallel to the first predetermined direction D1. The operating member 235 has an operating surface provided with a non-slip pattern 2351 so as to move the operating member 235 by pushing against the operating surface. In this embodiment, the direction D1 is a direction toward the backrest 212.

The operation principle of first adjusting mechanism 23*a* is described in detail below:

As shown in FIG. 18, when the relative positions of the carrier base 211 and the side plate 213 need to be adjusted, the operating member 235 can be pushed in the direction D1, and the operating member 235 drives the driving member 233 to move in the direction D1, and the second abutting bevel 2323 pushes against the first abutting bevel 23321 in the direction D1, so that the locking member 232 pivots toward the R1 direction (counterclockwise in this embodiment) against the elastic force of the fourth resetting member 234. Thus, the locking portion 2321 is disengaged from one of the plurality of locking holes 236, thereby enabling the carrier base 211 to move relative to the side plate 213. When the carrier base 211 is moved to the desired position, the operating member 235 is released, that is, the external force applied to the operating member 235 is removed, and the locking member 232 pivots in a reverse direction of R1 under the elastic force of the fourth resetting member 234, so that the locking portion 2321 is re-engaged with another of the plurality of locking holes 236, and the driving member 233 is returned to the initial position in the direction D1 by the driving engagement of the first abutting bevel 23321 and the second abutting bevel 2323, thereby driving the operating member 235 to return to the initial position together.

In some embodiments, as shown in FIG. 16, the high chair 2 further includes a pedal 24 located between two support brackets 22. The pedal 24 is movable relative to the two support brackets 22. Specifically, the pedal 24 is movably connected between the two front support brackets 221. In this embodiment, the first component may be the support bracket 22 and the second component may be the pedal 24. The predetermined direction is the direction D2 or the reverse direction of the direction D2 in which the pedal 24 is relatively away from or close to the carrier base 211, that is, the up-down direction in FIG. 21. The adjusting mechanism includes a second adjusting mechanism 23*b*. The pedal 24 is connected to two support brackets 22 through two second adjusting mechanisms 23*b* respectively and movable through the second adjusting mechanism 23*b* in the second predetermined direction D2.

Figure 20:
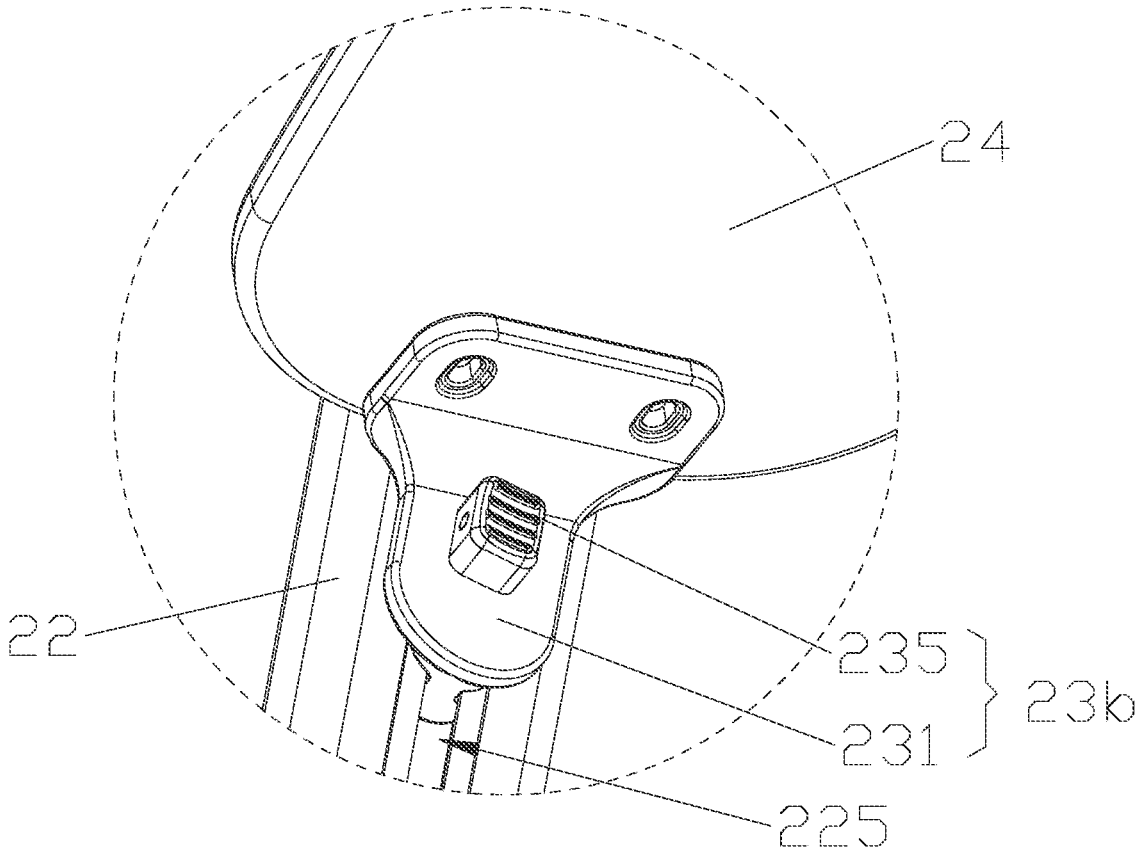
FIG. 20 is an enlarged view of portion C in FIG. 15.
Figure 21:
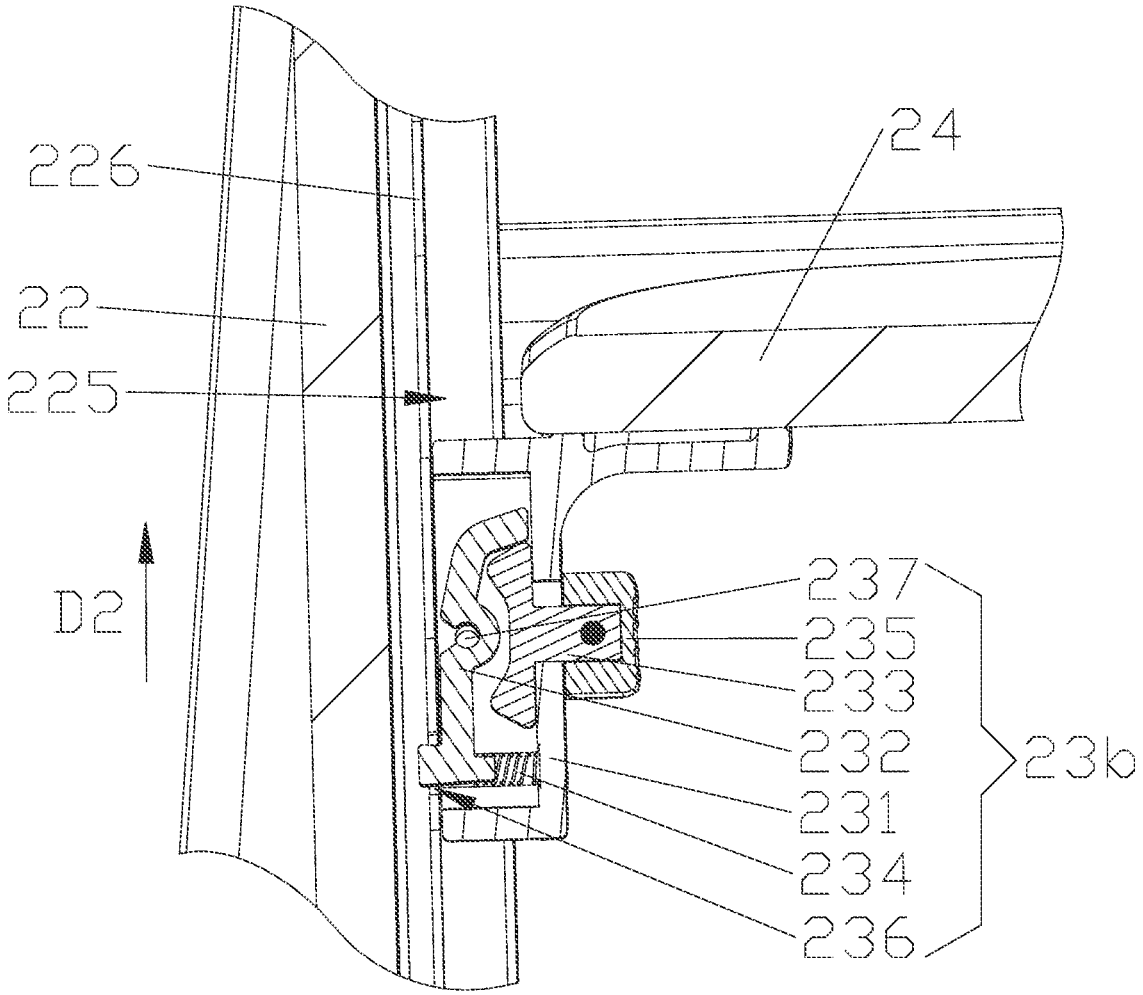
FIG. 21 is a partial cross-sectional view of a second adjusting mechanism of the high chair according to an embodiment of the present disclosure, showing the second adjusting mechanism at a locked state.

Referring to FIGS. 20 and 21, the structures of the second adjusting mechanism 23*b* and the first adjusting mechanism 23*a* are substantially identical, and each includes a connecting base 231, a locking member 232, a driving member 233, a fourth resetting member 234, an operating member 235, and a plurality of locking holes 236. The second adjusting mechanism 23*b* differs from the first adjusting mechanism 23*a* in that the connecting base 231 of the second adjusting mechanism 23*b* is fixedly connected to the pedal 24 and movably connected to the support bracket 22, and a plurality of locking holes 236 are provided on the support bracket 22 so that the pedal 24 can be releasably connected to the support bracket 22. Specifically, a second strip groove 225 is disposed on the support bracket 22. A part of the connecting base 231 is accommodated within and movable along the second strip groove 225. A second strip block 226 is provided in the second strip groove 225, and the second strip block 226 is fixedly connected to the bottom wall of the second strip groove 225. A plurality of locking holes 236 are provided on the second strip block 226 and in communication with the second strip groove 225. For the operation principle of the second adjusting mechanism 23*b*, reference may be made to the operation principle of the first adjusting mechanism 23*a*, and details are not described herein.

Figure 22:
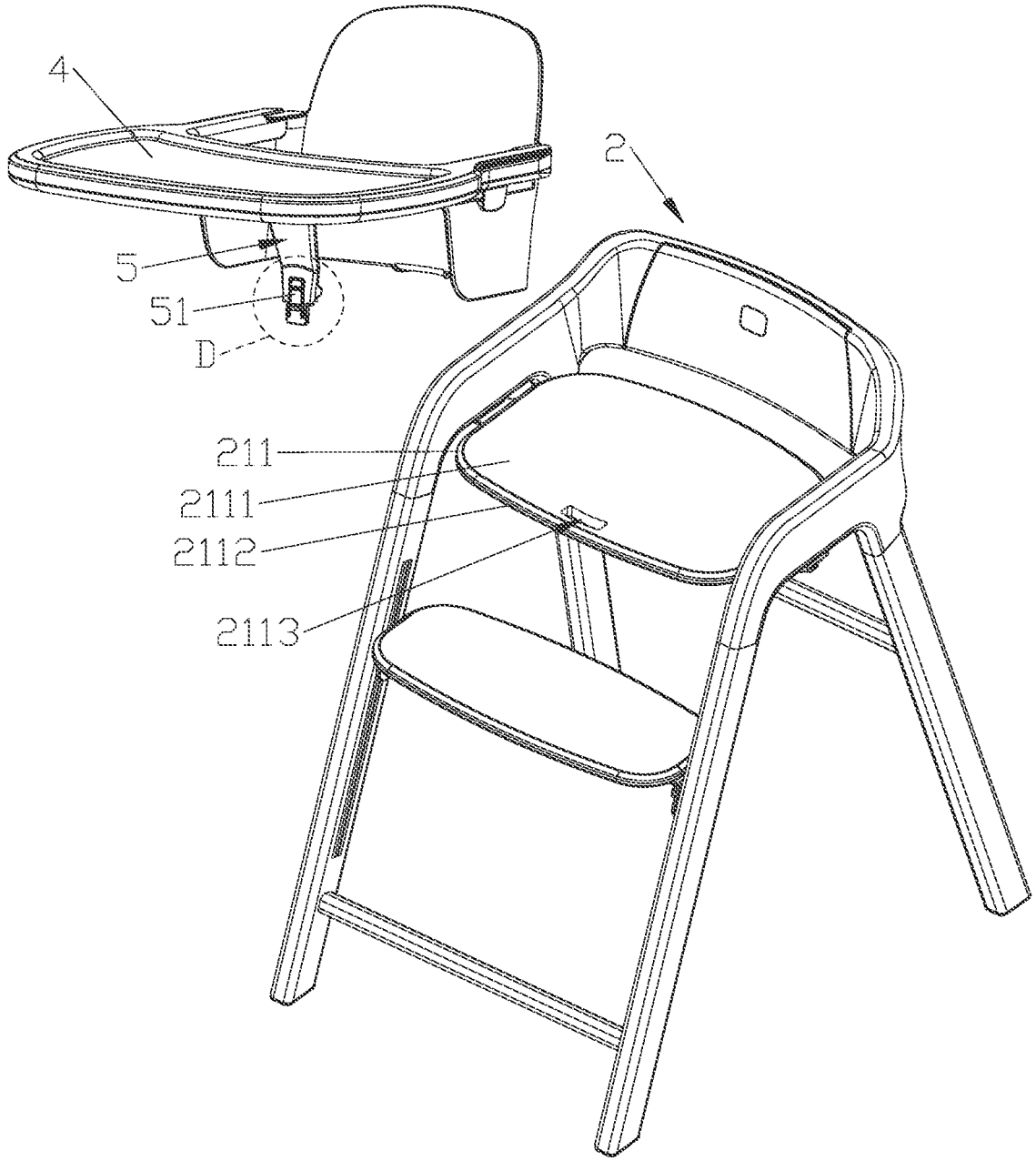
FIG. 22 is an exploded view of the seat assembly of FIG. 2.
Figure 23:
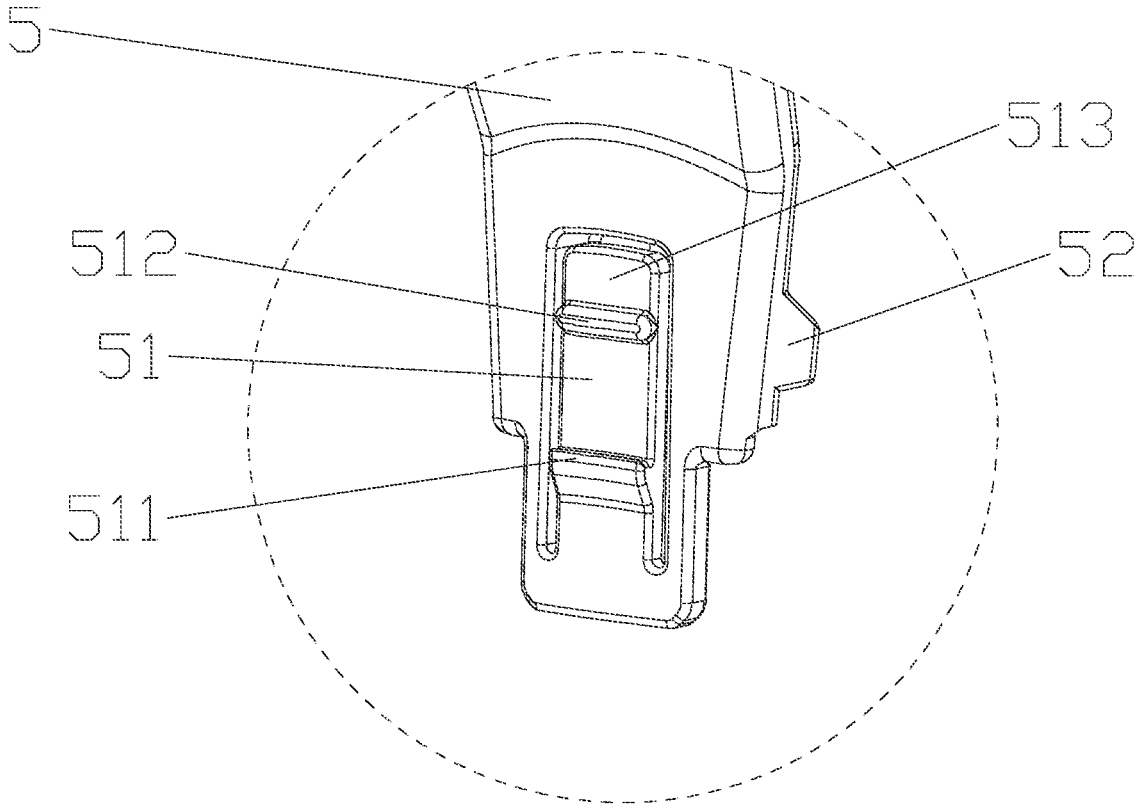
FIG. 23 is an enlarged view of portion D in FIG. 22.

In some embodiments, as shown in FIGS. 2, 22, and 23, the infant seat assembly further includes a dinner plate 4 and a blocking member 5. The blocking member 5 is capable of limiting the infant to the carrier base 211 of the high chair 2, and prevent the infant from accidentally falling out of the gap between the dinner plate 4 and the carrier base 211. The engaging device 1 is not connected to the high chair 2 when the infant seat assembly is in the second use mode. An end of the blocking member 5 is connected to the dinner plate 4 and the other end of the blocking member 5 is detachably connected to the carrier base 211.

Further, as shown in FIGS. 22 and 23, the other end of the blocking member 5 is provided with a resilient finger 51. An end of the resilient finger 51 is a free end 513 and extends toward the dinner plate 4. The resilient finger 51 has a second engaging projection 511, and the carrier base 211 has a second engaging hole 2113 disposed therethrough. The second engaging projection 511 passes through the carrier base 211 through the second engaging hole 2113 and abuts against an end face of the carrier base 211 opposite to the dinner plate 4 (i.e., the second side surface 2112 of the carrier base 211), so as to be detachably connected to the carrier base 211. The resilient finger 51 also has an operating projection 512 disposed close to the free end 513 relative to the second engaging projection 511, and the operating projection 512 is depressible. When the resilient finger 51 is inserted into the second engaging hole 2113, the operating projection 512 is located between the dinner plate 4 and the first side surface 2111 of the carrier base, so as to facilitate pressing of the operating projection 512. The blocking member 5 also has a limiting projection 52 capable of abutting the first side surface 2111 of the carrier base 211 to prevent the dinner plate 4 from moving excessively toward the carrier base 211. When the dinner plate 4 needs to be removed, the resilient finger 51 is deformed by pressing the resilient finger 51 (specifically, the operating projection 512 of the resilient finger 51), so that the second engaging projection 511 and the second side surface 2112 is disengaged from each other, whereby the blocking member 5 can be removed from the second engaging hole 2113, so that the dinner plate 4 and the blocking member 5 can be removed.

The engaging device 1 and the infant seat assembly have at least the following technical effects:

By connecting the engaging device 1 to the crossbar 91 of the baby carrier 9 and the carrier base 211 of the high chair 2, respectively, the baby carrier 9 can be easily and stably fixed to the high chair 2, so that a caregiver can conveniently and stably take care of an infant while eating a meal, and the infant can also conveniently share a meal with the caregiver.

Moreover, the carrier base 211 is slidable with respect to the side plate 213 to adjust the seating space of the high chair 2 (i.e., a space formed by enclosing the carrier base 211, the backrest 212, the side plate 213, and the like), so that the carrier base 211 can be applied to children of different sizes or ages, and the carrier base 211 can be adapted to mount baby carrier 9 of different sizes.

In the aforementioned engaging device and the infant seat assembly, by connecting the engaging device to the crossbar of the baby carrier and the carrier base of the high chair, respectively, the baby carrier can be easily and stably fixed to the high chair, thereby facilitating the care of the infant by the caregiver during the meal, and facilitating the infant to have a meal with the caregiver.

The technical features of the aforementioned embodiments may be combined arbitrarily. To simplify the description, not all the possible combinations of the technical features in the aforementioned embodiments are described. However, all of the combinations of these technical features should be considered as within the scope of the present disclosure, as long as such combinations do not contradict with each other.

The aforementioned embodiments only represent several examples of the present disclosure, and the description thereof is more specific and detailed, but it should not be construed as restricting the scope of the present disclosure. It should be noted that, for those skilled in the art, several variations and improvements may be made without departing from the concept of the present disclosure, and these are all within the protection scope of the present disclosure. Therefore, the protection scope of the present disclosure shall be defined by the appended claims.

What is claimed is:

1. An engaging device for fixing a baby carrier having a crossbar to a high chair having a carrier base, comprising:

an engaging base configured to be connected to the carrier base; and a first engaging mechanism movably disposed on the engaging base and adapted to releasably engage the crossbar with the engaging base, wherein the first engaging mechanism comprises:

an unlocking member movably connected to the engaging base and switchable between a locked state and an unlocked state, the unlocking member having an engaging portion; and when the unlocking member is in the locked state, the engaging portion is engaged with the crossbar, and when the unlocking member is in the unlocked state, the crossbar is disengaged from the engaging portion;

wherein the unlocking member has a first position and a second position; when:

the unlocking member is in the first position and in the locked state, the unlocking member is adapted to move from the locked state, via the second position, to the unlocked state; and the unlocking member is in the first position and in the unlocked state, the unlocking member is adapted to move from the unlocked state, via the second position, to the locked state, wherein the second position is a transition position that the unlocking member passes through during switching between the locked and unlocked state.

2. The engaging device of claim 1, wherein an accommodating cavity is formed inside the engaging base, at least a part of the unlocking member is located within the accommodating cavity, a part of the unlocking member located within the accommodating cavity has a connecting portion, the connecting portion is pivotally connected to a cavity wall of the accommodating cavity, and the engaging portion is capable of extending beyond the accommodating cavity to be engaged with the crossbar.

3. The engaging device of claim 2, wherein the engaging portion has a first engaging surface and the engaging base has a second engaging surface, when the unlocking member is in the locked state, the first engaging surface and the second engaging surface are arranged opposite to each other, and the crossbar is engaged between the first engaging surface and the second engaging surface.

4. The engaging device of claim 1, wherein the unlocking member is movably connected to the engaging base, the engaging portion has a wedge surface, and the wedge surface is adapted to be pushed against by the crossbar to enable the unlocking member to move.

5. An engaging device of claim 4, wherein the engaging portion has a first engaging surface, when the unlocking member is in the locked state, the crossbar is engaged between the first engaging surface and the engaging base, and the wedge surface and the first engaging surface are connected to each other and are angularly arranged.

6. The engaging device of claim 1, wherein the engaging portion has a wedge surface adapted to be pushed against by the crossbar to enable the unlocking member to move from the first position to the second position.

7. The engaging device of claim 1, wherein the first engaging mechanism further comprises:

an indication member movably disposed at the engaging base and switchable between at least two indication states to indicate an engaged state or a disengaged state of the unlocking member with the crossbar.

8. The engaging device of claim 7, wherein the indication member is provided with indication marks indicating at least two indication states, respectively, an accommodating cavity is formed inside the engaging base, the indication member is disposed in the accommodating cavity, and the engaging base is provided with an indication window for displaying any of the indication marks.

9. The engaging device of claim 7, wherein the at least two indication states comprise a first indication state for indicating that the crossbar is disengaged from the first engaging mechanism and a second indication state for indicating that the crossbar is engaged with the first engaging mechanism.

10. The engaging device of claim 7, wherein the first engaging mechanism further comprises:

an abutting member movably disposed at the engaging base and configured to drive the indication member to switch between at least two indication states.

11. The engaging device of claim 10, wherein the abutting member is switchable between an extended position and a retracted position, when the abutting member is switched from the extended position to the retracted position, the abutting member pushes the indication member to switch from a first indication state for indicating that the crossbar is disengaged from the first engaging mechanism to a second indication state for indicating that the crossbar is engaged with the first engaging mechanism.

12. The engaging device of claim 10, wherein the indication member has a first driving bevel, and an end of the abutting member is provided with a second driving bevel adapted to abut against the first driving bevel to drive the indication member to switch between the at least two indication states.

13. The engaging device of claim 10, wherein the abutting member is switchable between an extended position and a retracted position, when the abutting member is in the retracted position, the crossbar is capable of being engaged between the first engaging surface and the abutting member, and when the abutting member is in the extended position, the crossbar is disengaged from the first engaging surface.

14. An engaging device for fixing a baby carrier having a crossbar to a high chair having a carrier base, comprising:

an engaging base configured to be connected to the carrier base;

a first engaging mechanism movably disposed on the engaging base and adapted to releasably engage the crossbar with the engaging base; and a second engaging mechanism comprising:

an engaging member connected to the carrier base and provided with a first engaging hole;

a resilient arm connected to the engaging base; and a first engaging projection disposed on the resilient arm and adapted to be engaged with the first engaging hole.

15. The engaging device of claim 14, wherein the engaging member and the carrier base form a mounting groove for mounting at least a part of the engaging base, when at least a part of the engaging base is inserted into the mounting groove, the resilient arm enters the mounting groove and the first engaging projection is engaged with the first engaging hole.

16. The engaging device of claim 15, wherein the engaging base has an opening groove, an end of the resilient arm is connected to a groove wall of the opening groove, the first engaging projection has an engaged position, in which the first engaging projection protrudes from the opening groove; and a retracted position, in which the first engaging projection does not protrude from the opening groove, when the first engaging projection is in the engaged position, the first engaging projection is capable of being engaged with the first engaging hole, when the engaging base is inserted into the mounting groove, the engaging member is capable of pushing the first engaging projection to move to the retracted position, and the resilient arm is adapted to bias the first engaging projection to move the first engaging projection to the engaged position.

17. The engaging device of claim 16, wherein the engaging base is provided with a clamping slot, and when the first engaging projection is engaged with the first engaging hole, at least a part of the carrier base is inserted into the clamping slot.

18. The engaging device of claim 16, wherein the engaging base is provided with a clamping slot having a first side wall, the opening groove is provided on the first side wall, the engaging member and the carrier base form a mounting groove for an insertion of the engaging base, and when at least a part of the engaging base is inserted into the mounting groove, at least a part of the carrier base is inserted into the clamping slot, and the first engaging projection is engaged with the first engaging hole.

19. An infant seat assembly, comprising:

a high chair comprising a carrier base;

a baby carrier comprising a crossbar; and an engaging device, the baby carrier is adapted to be detachably mounted to the carrier base of the high chair by the engaging device, the engaging device comprising:

an engaging base configured to connect to the carrier base; and a first engaging mechanism movably disposed on the engaging base and adapted to releasably engage the crossbar with the engaging base, the first engaging mechanism comprising:

an unlocking member movably connected to the engaging base and switchable between a locked state and an unlocked state, the unlocking member having an engaging portion, when the unlocking member is in the locked state, the engaging portion is engaged with the crossbar, and when the unlocking member is in the unlocked state, the crossbar is disengaged from the engaging portion;

wherein the engaging portion has a first engaging surface and the engaging base has a second engaging surface, when the unlocking member is in the locked state, the first engaging surface and the second engaging surface are arranged opposite to each other, and the crossbar is engaged between the first engaging surface and the second engaging surface.

20. The infant seat assembly of claim 19, further comprising a third engaging mechanism, wherein the high chair further comprises a backrest, and the baby carrier is adapted to be detachably connected to the backrest by the third engaging mechanism.

21. The infant seat assembly of claim 20, wherein the third engaging mechanism comprises:

an engaging groove disposed on the backrest, wherein a side wall of the engaging groove is provided with a first protruding portion that is spaced apart from a bottom wall of the engaging groove to form a locking hook groove; and a locking hook member disposed on the baby carrier, wherein the locking hook member has a hook body adapted to be engaged in the locking hook groove to fix the locking hook member in the engaging groove.

22. The infant seat assembly of claim 21, wherein the third engaging mechanism further comprises a decorative cover movably disposed on the engaging groove, and the decorative cover is adapted to cover a notch of the engaging groove when the hook body is disengaged from the locking hook groove.

23. The infant seat assembly of claim 22, wherein the decorative cover has a first end away from the bottom wall of the engaging groove and a second end facing toward the bottom wall of the engaging groove, the second end is provided with a second protruding portion located between the first protruding portion and the bottom wall of the engaging groove, and the decorative cover is switchable between a third position and a fourth position; when the decorative cover is located in the third position, the first end is flush with a surface of the backrest and the second protruding portion abuts against the first protruding portion; when the decorative cover is in the fourth position, the second protruding portion and the first protruding portion are spaced apart so that the hook body is capable of being engaged in the locking hook groove.

24. The infant seat assembly of claim 19, wherein the high chair has a first component and a second component that are relatively movable, and an adjusting mechanism connected to the first component and the second component, respectively, the adjusting mechanism is switchable between a locked state and an unlocked state; when the adjusting mechanism is in the unlocked state, the first component is movable in a predetermined direction relative to the second component; when the adjusting mechanism is in a locked state, the first component is fixed relative to the second component.

25. The infant seat assembly of claim 24, wherein the adjusting mechanism comprises:

a plurality of locking holes disposed in one of the first component and the second component, and arranged in the predetermined direction; and a locking member movably connected to another of the first component and the second component, wherein the locking member comprises a locking portion and is switchable between a locked position and an unlocked position, the locking portion is inserted into any of the locking holes when the locking member is in the locked position, and the locking portion is disengaged from any of the plurality of locking holes when the locking member is in the unlocked position.

26. The infant seat assembly of claim 25, wherein the locking member further comprises a locking body pivotally connected to the other of the first component and the second component by a pivot shaft, the locking portion is disposed at an end of the locking body, and the locking body is operable to switch the locking portion between the locked position and the unlocked position.

27. The infant seat assembly of claim 26, wherein the adjusting mechanism further comprises a driving member comprising a driving portion and an operating portion, the driving portion abuts against the locking body, and the operating portion is operable to cause the driving portion to push the locking body to pivot.

28. The infant seat assembly of claim 26, wherein the adjusting mechanism further comprises a driving member, the driving member comprises a driving portion and an operating portion, the driving portion has a first abutting bevel, the locking body is provided with a second abutting bevel opposite to the first abutting bevel, and the operating portion is operable to cause the second abutting bevel to push against the first abutting bevel, causing the locking member to pivot.

29. The infant seat assembly of claim 25, further comprising a connecting base fixed to the other of the first component and the second component, wherein the connecting base is provided with an accommodating groove, the locking member is movably disposed in the accommodating groove, and the locking portion is adapted to extend out of a notch of the accommodating groove to be inserted into any of the locking holes.

30. The infant seat assembly of claim 29, wherein the adjusting mechanism further comprises a driving member, the driving member comprises a driving portion and an operating portion, the driving portion abuts against the locking member, a bottom wall of the accommodating groove is provided with a strip hole, the operating portion extends out of the connecting base through the strip hole to be operated, and the operating portion is operable to cause the driving portion to drive the locking member to switch between a locked position and an unlocked position.

* * * * *